US010855017B2

(12) United States Patent
Nakazono et al.

(10) Patent No.: US 10,855,017 B2
(45) Date of Patent: Dec. 1, 2020

(54) CONNECTOR TERMINAL, CONNECTOR, AND SIZE ADJUSTMENT DEVICE

(71) Applicants: TATSUTA Electric Wire & Cable Co., Ltd., Higashiosaka (JP); Iwanuma Seiko Corporation, Iwanuma (JP)

(72) Inventors: Syoji Nakazono, Kizugawa (JP); Kiyotaka Urashita, Kizugawa (JP); Koji Chiba, Iwanuma (JP); Kokichi Hori, Iwanuma (JP)

(73) Assignees: Tatsuta Electric Wire & Cable Co., Ltd., Osaka (JP); Iwanuma Seiko Corporation, Miyagi (JP)

( * ) Notice: Subject to any disclaimer, the term of this patent is extended or adjusted under 35 U.S.C. 154(b) by 0 days.

(21) Appl. No.: 16/257,745

(22) Filed: Jan. 25, 2019

(65) Prior Publication Data

US 2019/0237894 A1 Aug. 1, 2019

(30) Foreign Application Priority Data

Jan. 26, 2018 (JP) ..... 2018-011876

(51) Int. Cl.
*H01R 4/18* (2006.01)
*H01R 13/432* (2006.01)
(Continued)

(52) U.S. Cl.
CPC ..... *H01R 13/432* (2013.01); *H01R 4/18* (2013.01); *H01R 4/184* (2013.01); *H01R 13/11* (2013.01);
(Continued)

(58) Field of Classification Search
CPC .. H01R 13/432; H01R 4/184; H01R 13/4223; H01R 43/16; H01R 13/11; H01R 4/18;
(Continued)

(56) References Cited

U.S. PATENT DOCUMENTS 3,980,385 A 9/1976 Hirokawa et al.
4,002,400 A 1/1977 Evans
(Continued)

FOREIGN PATENT DOCUMENTS

CN 1184346 A 6/1998
CN 102163783 A 8/2011
(Continued)

*Primary Examiner* — Truc T Nguyen
(74) *Attorney, Agent, or Firm* — The Webb Law Firm

(57) ABSTRACT

Provided is a connector terminal, including: a tubular section having a lance formed by cutting a part of a peripheral wall thereof and raising the same about its base part. At least a portion of the peripheral wall in which the lance is cut and raised is curved to bulge outward as seen from an opening direction of the tubular section. The lance has a pair of end edges opposed to each other in a width direction orthogonal to a direction in which the lance extends, and at least one of the pair of end edges at least on the side of the base part of the lance is formed to come close to an opposed one of the at least one of the end edges as it advances toward a leading end of the lance. Also provided are a connector including the connector terminal, and a size adjustment device.

3 Claims, 25 Drawing Sheets

(51) Int. Cl.
*H01R 13/642* (2006.01)
*H01R 13/11* (2006.01)
*H01R 43/16* (2006.01)
*H01R 13/422* (2006.01)

(52) U.S. Cl.
CPC ..... *H01R 13/4223* (2013.01); *H01R 13/642* (2013.01); *H01R 43/16* (2013.01)

(58) Field of Classification Search
CPC ..... H01R 13/642; H01R 43/20; H01R 13/46; H01R 13/111
See application file for complete search history.

(56) References Cited

U.S. PATENT DOCUMENTS 4,776,651 A 10/1988 Paulo
5,133,672 A * 7/1992 Nelligan, Jr. ..... H01R 4/2466 439/397
5,376,012 A 12/1994 Clark
5,588,852 A 12/1996 Puemer
5,624,283 A * 4/1997 Hotea ..... H01R 13/18 439/751
5,653,616 A 8/1997 Hotea
5,857,879 A 1/1999 Endo et al.
5,924,887 A * 7/1999 Aoyama ..... H01R 4/2466 439/400
5,951,336 A * 9/1999 Seko ..... H01R 13/432 439/745
6,186,837 B1 2/2001 Abe
6,434,820 B1 * 8/2002 Volstorf ..... H01R 4/2466 29/753
6,558,208 B2 * 5/2003 Suzuki ..... H01R 4/185 439/878
7,347,741 B1 * 3/2008 Yeomans ..... H01R 4/185 439/744
7,931,509 B2 4/2011 Shaw et al.
2001/0051471 A1 * 12/2001 Saka ..... H01R 13/465 439/843
2003/0224656 A1 * 12/2003 Yoshida ..... H01R 9/0518 439/578
2004/0110414 A1 * 6/2004 Harada ..... H01R 13/114 439/527
2009/0036001 A1 2/2009 Ishigami
2009/0197479 A1 8/2009 Glick et al.
2010/0130038 A1 5/2010 Tomita et al.
2011/0177722 A1 7/2011 Casses et al.
2012/0202391 A1 8/2012 Kobayashi et al.
2013/0052883 A1 * 2/2013 Iihoshi ..... H01R 13/434 439/748
2014/0073163 A1 * 3/2014 Kojima ..... H01R 13/5205 439/275
2016/0020528 A1 1/2016 Miyakawa
2017/0040728 A1 * 2/2017 Saito ..... H01R 13/11
2017/0170591 A1 * 6/2017 Uezono ..... H01R 13/40
2018/0083380 A1 * 3/2018 Goto ..... H01R 4/185
2019/0006772 A1 1/2019 Nakazono et al.
2019/0006783 A1 1/2019 Nakazono et al.
2019/0237888 A1 8/2019 Nakazono et al.
2019/0237894 A1 8/2019 Nakazono et al.

FOREIGN PATENT DOCUMENTS

CN 204030074 U 12/2014
CN 210897726 U 6/2020
JP 4996474 U 8/1974
JP S5061384 U 6/1975
JP S61195714 A 8/1986
JP H03008892 U 1/1991
JP H04102167 U 9/1992
JP 517951 U 3/1993
JP H06104059 A 4/1994
JP H113739 A 1/1999
JP 2012502442 A 1/2012
JP 2012109200 A 6/2012

* cited by examiner

CONNECTOR TERMINAL, CONNECTOR, AND SIZE ADJUSTMENT DEVICE

CROSS-REFERENCE TO RELATED APPLICATION

This application claims priority to Japanese Patent Application No. 2018-011876 filed Jan. 26, 2018, the disclosure of which is hereby incorporated by reference in its entirety.

FIELD OF THE INVENTION

The present invention relates to a connector terminal including a lance, a connector including the connector terminal, and a size adjustment device.

BACKGROUND OF THE INVENTION

A connector terminal including a lance is conventionally known (see Japanese Unexamined Utility Model Application Publication No. H5-017951). As shown in FIG. 25, this connector terminal includes a lance 502 formed by cutting and raising a substantial center portion of a plate-shaped base 501 made of metal. The lance 502 is configured to come into locking engagement with a locking projection provided inside a connector housing when the connector terminal 500 is housed into the connector housing, to prevent the connector terminal 500 from slipping off the connector housing. The lance 502 shown in FIG. 25 has a pair of end edges 502*a* that are opposed to each other in its width direction (i.e., a direction orthogonal to a direction in which the lance 502 extends) and that extend straight in parallel with each other.

In the aforementioned connector terminal 500, adjusting the degree to which the aforementioned lance 502 is opened (hereinafter referred to as the opening degree), which is for example slightly increasing the opening degree, can be difficult due to the elasticity of the lance 502.

SUMMARY OF THE INVENTION

It is therefore an object of the present invention to provide a connector terminal that enables easy adjustment of the opening degree of a lance, a connector that includes the connector terminal, and a size adjustment device.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

According to one aspect of the present invention, there is provided a connector terminal including: a tubular section having a lance formed by cutting a part of a peripheral wall thereof and raising the same about its base part, wherein at least a portion of the peripheral wall near the base part of the lance is curved to bulge outward as seen from an opening direction of the tubular section, and wherein the lance has a pair of end edges opposed to each other in a width direction orthogonal to a direction in which the lance extends, and at least one of the pair of end edges at least on a side of the base part of the lance is formed to come close to an opposed one of the at least one of the pair of end edges as it advances toward a leading end of the lance.

According to another aspect of the present invention, there is provided a connector including: the connector terminal; and a connector housing having an inner surface that surrounds the tubular section of the connector terminal in a peripheral direction and having a terminal housing part configured to house the connector terminal, wherein the tubular section has a pair of the lances provided at positions opposed to each other in the peripheral direction, and wherein each of the pair of the lances has a leading end abutting the inner surface.

The configuration can be such that the connector terminal has a conductive part that is arranged on one side in the opening direction of the tubular section and enables a mating terminal to be detachably connected to itself from the opening direction, is the connector terminal being configured to be housed in the terminal housing part with the conductive part held in position.

According to still another aspect of the present invention, there is provided a size adjustment device including: a pressing section capable of pressing a portion to be pressed, which is a peripheral direction of a tubular section of a member having the tubular section, toward an inside of the tubular section; and a supporting unit capable of supporting a residual portion in the peripheral direction of the tubular section other than the portion to be pressed, by abutting on the residual portion from an outer side.

The configuration can be such that the size adjustment device includes: a pair of first force transmission members capable of reciprocating in a pressing direction of the pressing section, wherein the pressing section includes a pressing part capable of pressing in the pressing direction and a second force transmission member extending in the pressing direction and configured to transmit pressing force applied by the pressing part to the portion to be pressed, wherein the supporting unit includes a pair of pinching members each having a rotation fulcrum that is located at a position closer in the pressing direction to the pressing part than an arrangement position of the tubular section and being configured to pivotally move about the rotation fulcrums to be capable of pinching the tubular section arranged at the arrangement position from a direction substantially orthogonal to the pressing direction, wherein each of the pair of pinching members has an inclined surface located along an outer end portion in the pinching direction and inclined relative to the pressing direction so as to be away from the counterpart pinching member as it advances from the pressing portion, and wherein each of the pair of first force transmission members is arranged between the pressing part and the inclined surface of a corresponding one of the pair of pinching members in the pressing direction, and is configured to slide along the inclined surface while pressing the inclined surface in the pressing direction as each of the pair of first force transmission members moves in the pressing direction by the pressing force of the pressing part, so that the pinching members respectively having the inclined surfaces pivotally move toward each other.

The configuration can be such that the supporting unit includes an opposed portion supporting member capable of supporting an opposed portion of the tubular section that is opposed to the portion to be pressed of the tubular section, and the pair of pinching members are configured to pinch a part of the residual portion other than the opposed portion of the tubular section.

The configuration can be such that pressing of the tubular section by the pressing section and pinching of the tubular section by the pair of pinching members are completed simultaneously.

BRIEF DESCRIPTION OF DRAWINGS

The foregoing and other features of the present invention will become apparent from the following description and drawings of an illustrative embodiment of the invention in which.

DETAILED DESCRIPTION OF THE PREFERRED EMBODIMENT

Hereinafter, an embodiment of the present invention will be described with reference to FIG. 1 to FIG. 9.

Figure 1:
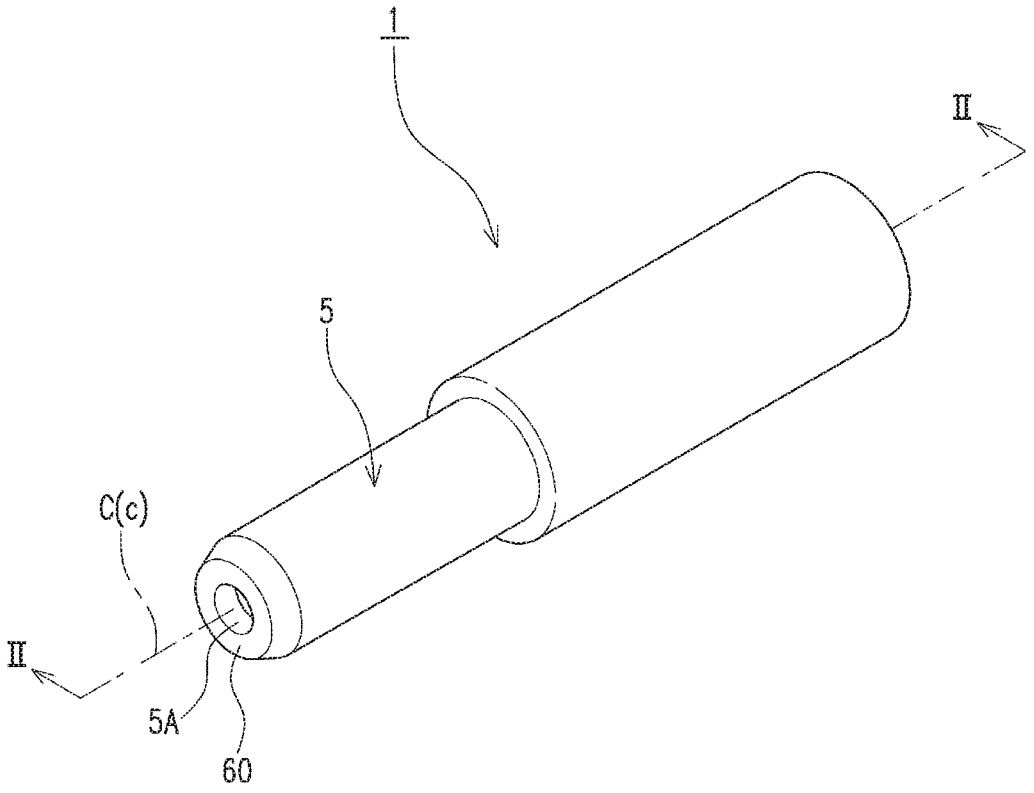
FIG. 1 is a perspective view of a connector according to an embodiment.
Figure 2:
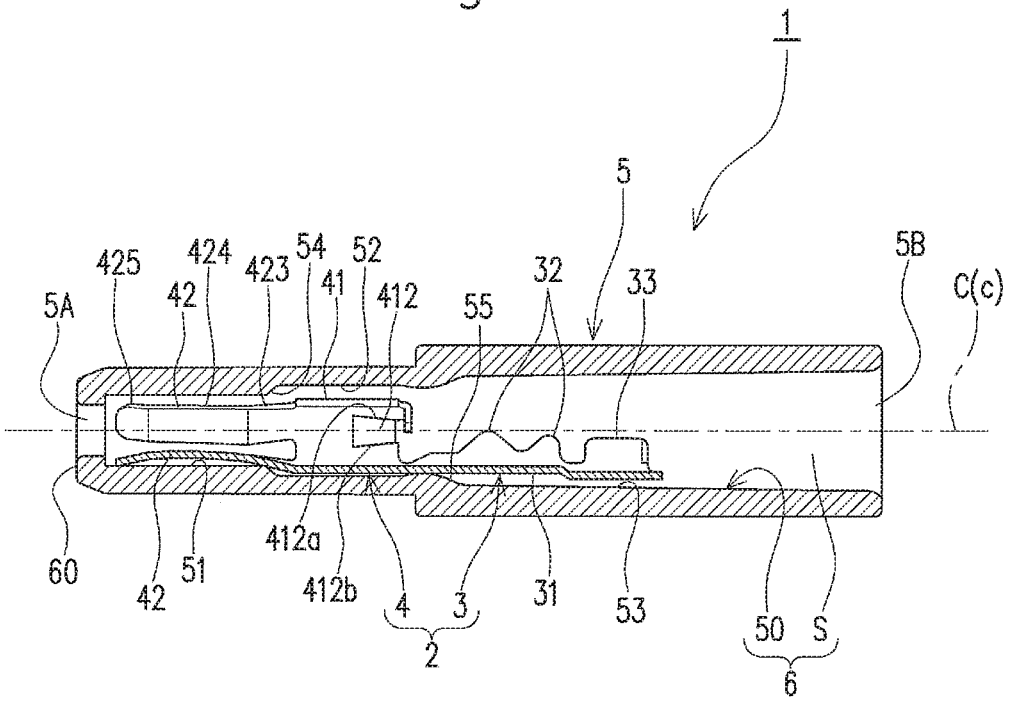
FIG. 2 is a cross sectional view taken along line II-II in FIG. 1.

As shown in FIG. 1 and FIG. 2, a connector 1 according to this embodiment includes a connector terminal 2 to which an electric wire is connected, and a connector housing (hereinafter referred to simply as "housing") 5 in which the connector terminal 2 is housed. The connector 1 of this embodiment is a female connector to which a mating terminal such as a male connector is connected.

Figure 3:
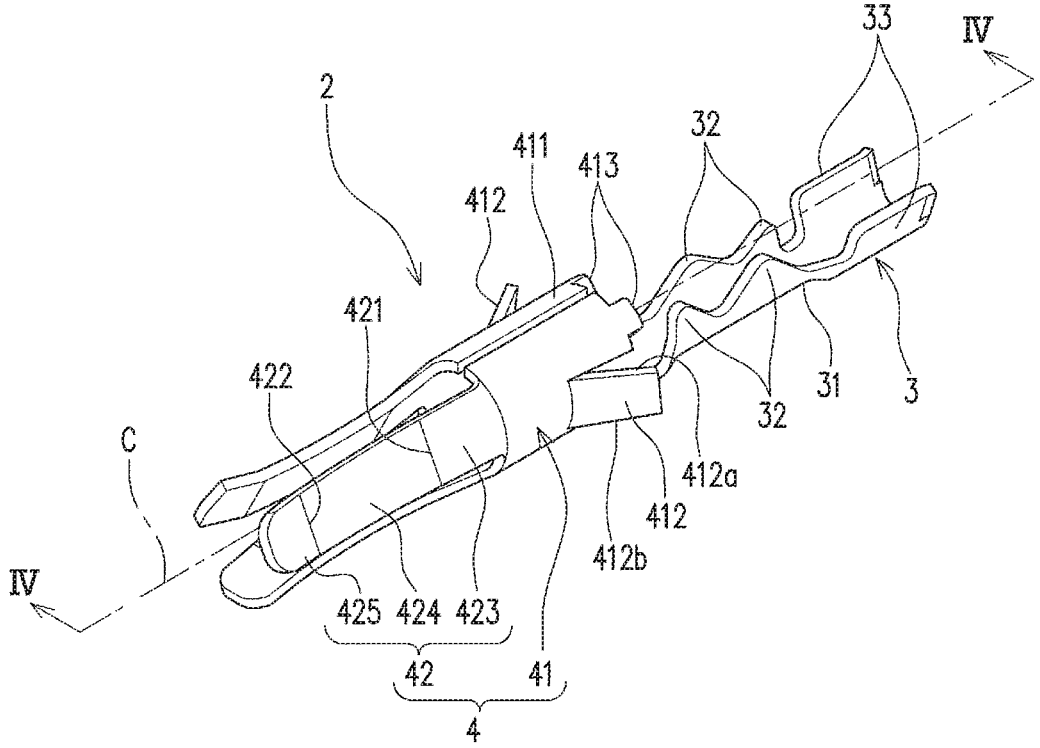
FIG. 3 is a perspective view of a connector terminal.
Figure 4:
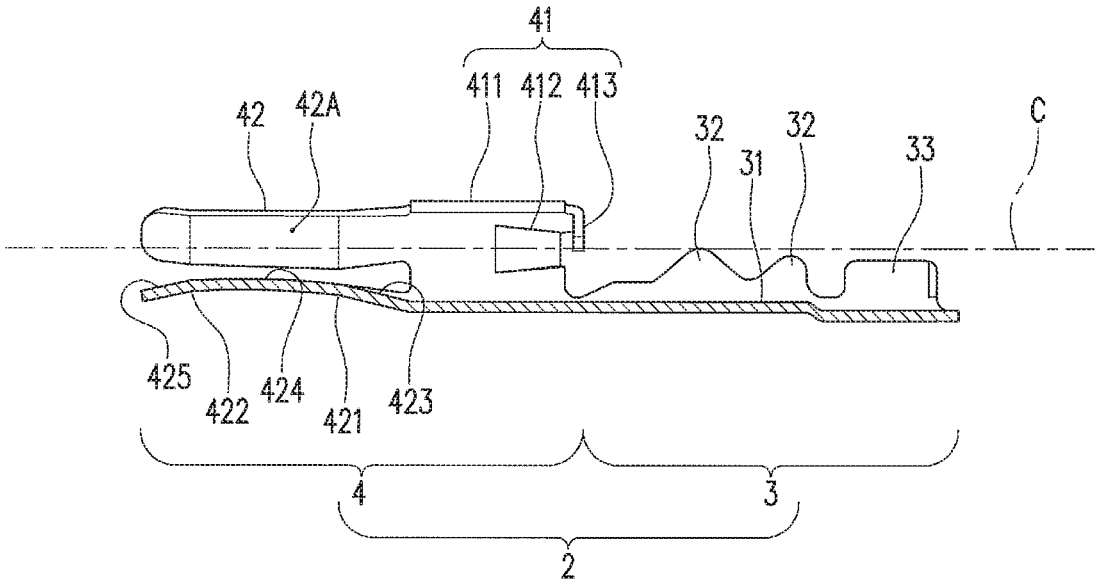
FIG. 4 is a cross sectional view taken along line IV-IV in FIG. 3.
Figure 5:
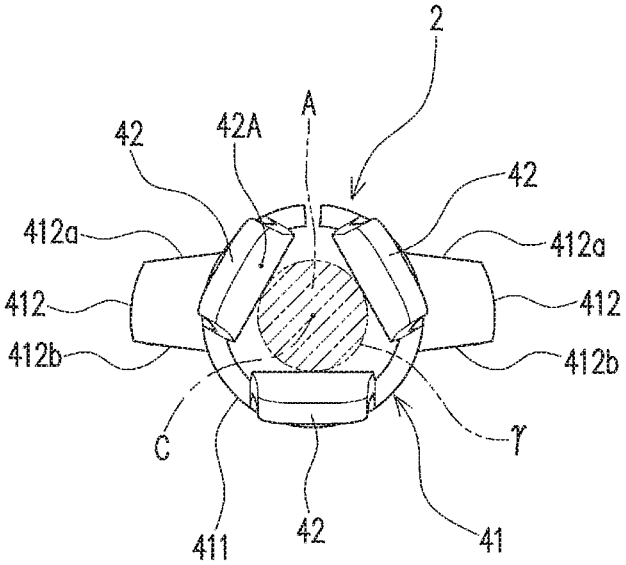
FIG. 5 is a view of the connector terminal as seen from its distal end side in a direction of a central axis of the connector terminal.

As shown in FIG. 3 to FIG. 5, the connector terminal 2 includes a tubular section 41 that has a lance 412 formed by cutting a part of a peripheral wall thereof and raising the same about its base part. The connector terminal 2 includes a connection part 4 that includes the tubular section 41 and enables the mating terminal (a mating terminal pin P in this embodiment: see FIG. 7) to be detachably connected to itself from an opening direction of the tubular section 41 (i.e., the left and right direction in FIG. 4).

Specifically, the connector terminal 2 is a so-called contact terminal, and includes a terminal base 3 to which an electric wire is connectable, and the connection part 4 that is provided continuously with the terminal base 3 and enables the mating terminal pin P to be detachably connected to itself. The connector terminal 2 of this embodiment is formed of a conductive metal sheet that is stamped out into a specific shape (see FIG. 6) and then bent into a tubular shape with an axis parallel to a centerline C1 as a central axis C. The connector terminal 2 of this embodiment is formed of phosphor bronze, but may also be formed of brass, nickel silver, plated stainless steel, or the like. Hereinafter, in a direction of the central axis C, a connection part 4 side (the left side in FIG. 2) is referred to as a distal end side, and a terminal base 3 side (the right side in FIG. 2) is referred to as a proximal end side.

The terminal base 3 includes a plate-shaped base body 31 extending in the direction of the central axis C, a plurality of conductive crimping pieces 32 extending from the base body 31, and a pair of covered part crimping pieces 33 extending from a portion of the base body 31 closer to the proximal end side thereof than the conductive crimping pieces 32.

The conductive crimping pieces 32 are crimped to embrace a core wire (a conductor) exposed in a leading end portion of the electric wire so that the core wire is press-contacted to the base body 31.

The covered part crimping pieces 33 are configured to be crimped to have an insulation covered portion of the electric wire near the exposed core wire sandwiched between the base body 31 and the covered part crimping pieces 33, so that the connector terminal 2 is fixed to the electric wire.

Figure 6:
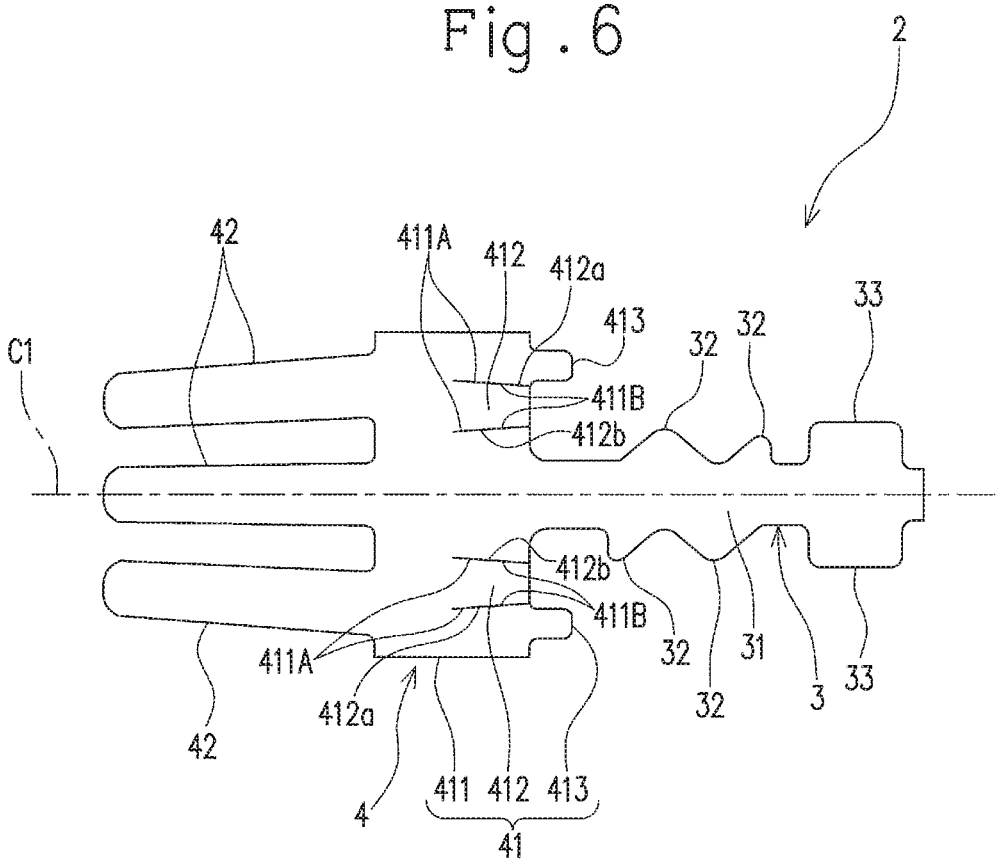
FIG. 6 is a development view of the connector terminal.

In the connector terminal 2 before it is bent as aforementioned (i.e., it is in the state shown in FIG. 6: hereinafter referred to as "flat plate-shaped connector terminal 2"), the plurality of conductive crimping pieces 32 extend from both sides in a width direction of the base body 31 (i.e., a direction orthogonal to the centerline C1: a vertical direction in FIG. 6) toward the outside thereof in the width direction. In the connector terminal 2 of this embodiment, the conductive crimping pieces 32 on one side in the width direction (i.e., the upper side in FIG. 6) and the conductive crimping pieces 32 on the other side (i.e., the lower side in FIG. 6) alternately extend while being displaced from each other in the direction of the centerline C1 (i.e., they are alternately arranged).

In the base body 31 of the flat plate-shaped connector terminal 2, the pair of covered part crimping pieces 33 respectively extend toward the outside in the width direction from portions adjacent to the conductive crimping pieces 32 on the proximal end side thereof in the direction of the centerline C1. The covered part crimping piece 33 on the one side in the width direction and the covered part crimping piece 33 on the other side therein are both located at the same position with respect to the direction of the centerline C1.

The base body 31 is bent to be curved so that the terminal base 3 is formed from a part of the flat plate-shaped connector terminal 2 that includes the base body 31, the conductive crimping pieces 32, and the covered part crimping pieces 33.

The connection part 4 includes the tubular section 41 continuously provided with the base body 31, and a plurality of elastic contact pieces (conductive parts) 42 arranged at intervals around the central axis C. The connection part 4 is conductively connected (fitted) to the mating terminal pin P (see FIG. 7) when the mating terminal pin P is inserted into an area A (see FIG. 5) surrounded by the plurality of elastic contact pieces 42. In this embodiment, there are three elastic contact pieces 42.

The tubular section 41 includes a tubular body (peripheral wall) 411 surrounding the central axis C (i.e., having the central axis C), and the lance 412 extending outward from the tubular body 411 to come into locking engagement with the housing 5. The tubular section 41 of this embodiment includes a pair of lances 412 provided at positions opposed to each other in the peripheral direction thereof. The tubular section 41 further includes a stopper piece 413 extending from the proximal end of the tubular body 411 toward the central axis C.

Figure 7:
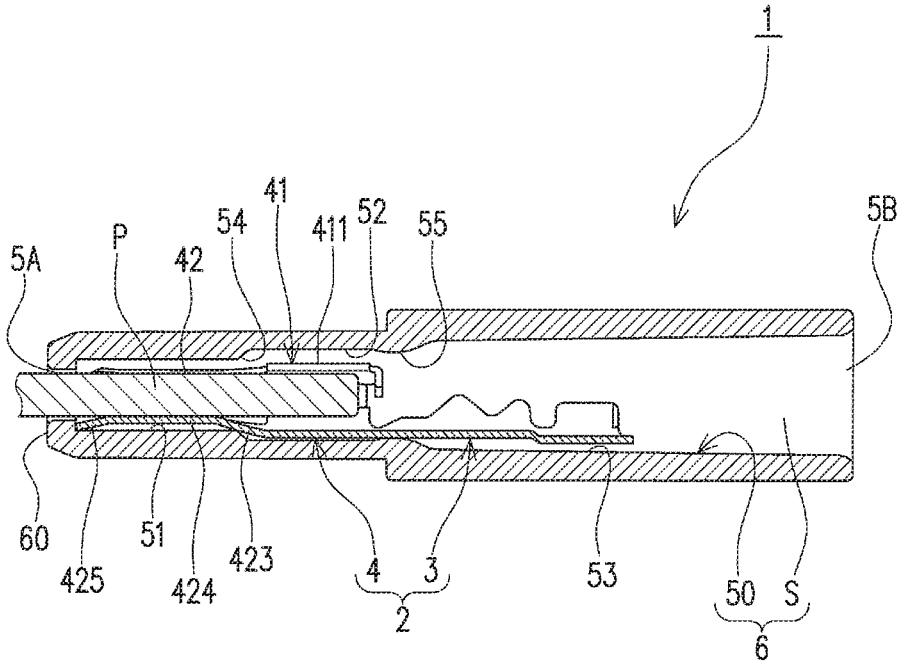
FIG. 7 is a cross sectional view showing a state where a mating terminal pin is fitted into the connector.
Figure 8:
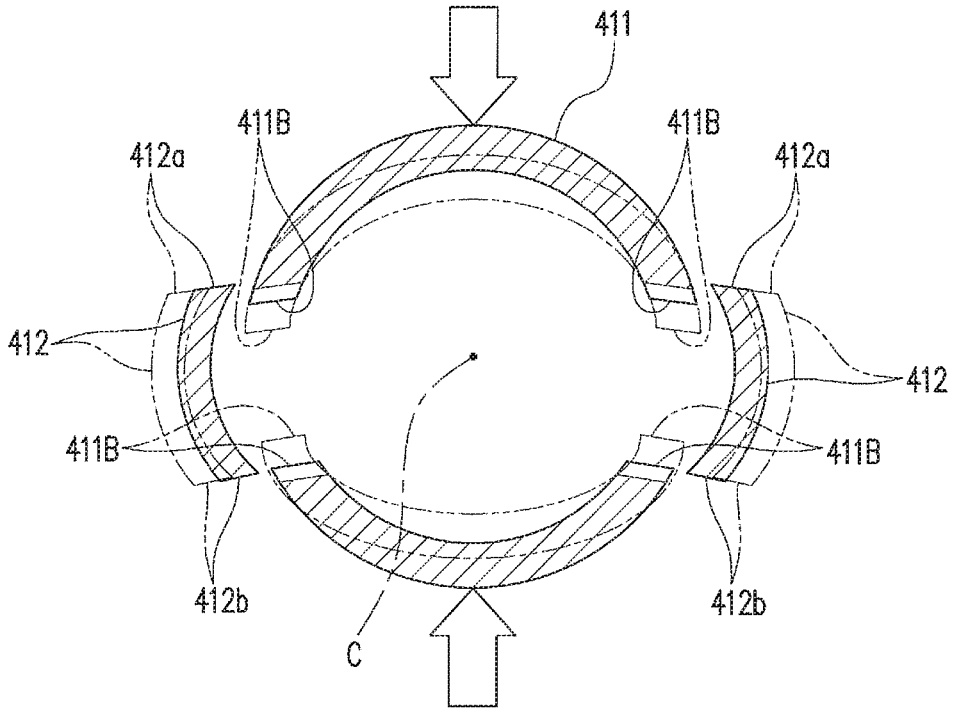
FIG. 8 is an explanatory view for the principle of how the opening degrees of lances change.
Figure 9:
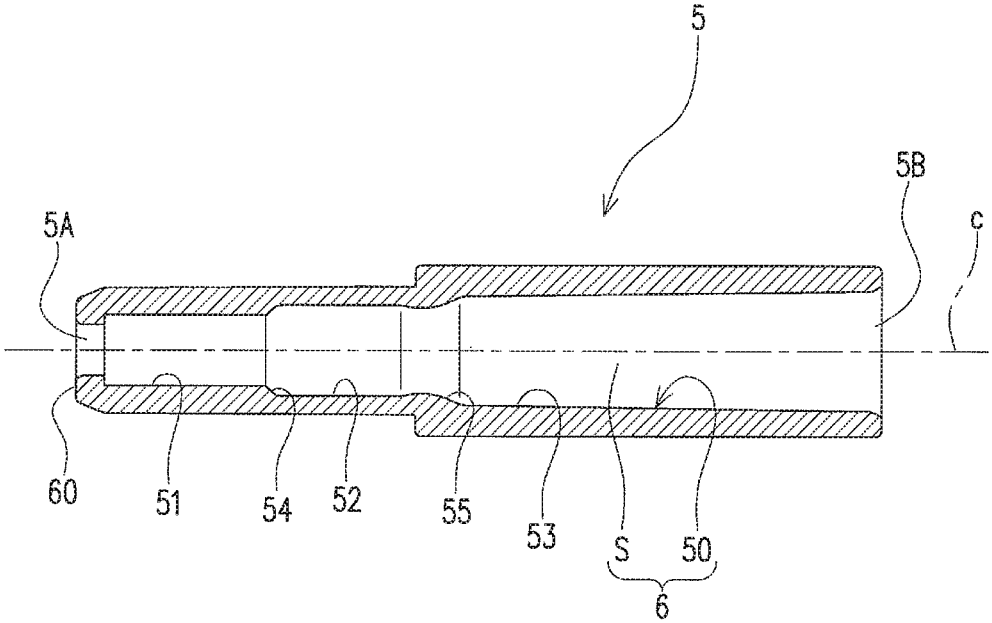
FIG. 9 is a cross sectional view of a connector housing used for the connector.

The tubular body 411 is a portion inside which a leading end portion of the mating terminal pin P is positioned (i.e. the area surrounded by the tubular body 411) when the mating terminal pin P is fitted to the connector 1 (see FIG. 7). In the tubular body 411, at least portions near the base parts (i.e., peripheral portions) of the pair of lances 412 are curved to bulge outward as seen from the opening direction of the tubular body 411, i.e., the left and right direction in FIG. 2 (see FIG. 5). The tubular body 411 of this embodiment is a rectangular plate portion of the plate-shaped connector terminal 2 elongated in a direction orthogonal to the centerline C1, and is formed with the portion being entirely curved into a tubular shape so as to make the central axis C as the center and having the edges in the longitudinal direction of the rectangular plate portion opposed to each other. The tubular body 411 of this embodiment has a circular cylindrical shape.

Each of the pair of lances 412 is configured to engage with an engagement portion (a lance engagement part 55 to be described later: see FIG. 2) provided inside the housing 5 when the connector terminal 2 is inserted through a proximal end opening 5B (see FIG. 2) into the inside of the housing 5 and moves to a specific position. This configuration allows the connector terminal 2 to be locked in the housing 5. The connector terminal 2 is consequently prevented from moving to the proximal end side inside the housing 5.

Specifically, each of the pair of lances 412 projects from the tubular body 411, and is inclined relative to the central axis C so as to be away from the central axis C as it advances toward the proximal end. The lance 412 has a pair of end edges 412*a* and 412*b* opposed to each other in the width direction orthogonal to the direction in which the lance 412 extends. The lance 412 has its leading end abutting an inner surface 50 of the housing 5. At least on the side of the base part of the lance 412, at least one end edge 412*a* (or 412*b*) of the pair of end edges 412*a* and 412*b* opposed to each other in the width direction orthogonal to the direction in which the lance 412 extends is formed to come close to the other end edge 412*b* (or 412*a*) as it advances toward the leading end of the lance 412. In the lance 412 of this embodiment, the pair of end edges 412*a* and 412*b* are made close to each other (i.e., the interval therebetween becomes small) as it advances from the base part of the lance 412 toward the leading end thereof. That is, each of the lances 412 of this embodiment is formed into a tapered shape.

The lance 412 as aforementioned is formed with a portion between a pair of cut lines 411A (see FIG. 6) that extend from a proximal end edge of the tubular section 411 of the flat plate-shaped connector terminal 2 toward a distal end edge thereof and are provided at an interval from each other in a direction orthogonal to the centerline C1, the portion being raised outward. The pair of cut lines 411A are made close to each other as they advance toward the proximal end. That is, the interval between the pair of cut lines 411A becomes small as it advances toward the proximal end (i.e., the leading end side of the lance 412).

The stopper piece 413 is configured to stop the leading end of the mating terminal pin P, when the mating terminal pin P is fitted to the connector 1, from moving further into the inside of the connector 1 (toward the proximal end of the connector 1). That is, the stopper piece 413 is configured to abut the leading end of the mating terminal pin P when the mating terminal pin P moving along the central axis C enters the tubular body 411 to thereby prevent the leading end of the mating terminal pin P from moving further into the inside of the connector 1. The stopper piece 413 is used when the connector terminal 2 is inserted into the housing 5. That is, the stopper piece 413 is pressed so that the connector terminal 2 of this embodiment is inserted (pressed) into the housing 5.

The stopper piece 413 is formed with a portion 413 extending in the direction of the centerline C1 from the proximal end edge of the tubular body 411 in the flat plate-shaped connector terminal 2 shown in FIG. 6, the portion 413 being bent toward the central axis C in the state where the tubular body 411 is in a tubular shape. In the connection part 4 of this embodiment, a plurality of (two in this embodiment) stopper pieces 413 are arranged at intervals in a circumferential direction of the tubular body 411.

The three elastic contact pieces (conductive parts) 42 extend along the central axis C, are pressed by the mating terminal pin P when the mating terminal pin P is inserted along the central axis C into the area A surrounded by the elastic contact pieces 42, and are thereby elastically deformed. The elastic contact pieces 42 are arranged at intervals from each other on the circumference of a circle with the central axis C as the center. A specific configuration of each of the elastic contact pieces 42 is described as follows.

The elastic contact pieces 42 are elastically-deformable plate-shaped portions that extend from the tubular section 41 toward the distal end (front side), and are arranged at equal intervals around the central axis C, with their main surfaces (i.e., surfaces orthogonal to a thickness direction thereof) 42A directed to the central axis C (see FIG. 4 and FIG. 5). Each of the elastic contact pieces 42 has two bent portions (i.e., a first bent portion 421 and a second bent portion 422) arranged at an interval from each other in the direction of the central axis C. Hereinafter, a portion of the elastic contact piece 42 more on the proximal end side than the first bent portion 421 is referred to as a base portion 423, a portion thereof between the first bent portion 421 and the second bent portion 422 is referred to as a contact portion 424, and a portion thereof more on the distal end side than the second bent portion 422 is referred to as a distal end portion 425.

The base portion 423 is inclined with respect to the central axis C so as to be away from the central axis C as it advances from the contact portion 424 toward the proximal end (see FIG. 4).

The contact portion 424 is a portion that is in contact (conduction) with the mating terminal pin P when the mating terminal pin P is inserted along the central axis C into the area A surrounded by the three elastic contact pieces 42 (see FIG. 7). The contact portion 424 extends along the central axis C and is curved in such a direction as to project toward the central axis C. With this curving, an inscribed circle y (see FIG. 5) that is centered at the central axis C and tangent to a portion of each of the contact portions 424 closest to the central axis C is made smaller than the outer periphery of the mating terminal pin P. This configuration causes the contact portions 424 to be pressed in a direction away from the central axis C by the mating terminal pin P that is inserted into the area A surrounded by the elastic contact pieces 42.

The distal end portion 425 extends from a distal end of the contact portion 424 (the edge on the opposite side to the base portion 423) and is positioned outward of the contact portion 424 in a direction orthogonal to the central axis C. The distal end portion 425 is inclined relative to the central axis C so as to be away from the central axis C as it advances from the contact portion 424 toward the distal end, and abuts the inner surface 50 (specifically, a first portion 51 of the inner surface 50) of the housing 5 (see FIG. 2 and FIG. 4). By the abutting of the distal end portion 425 on the inner surface 50 (the first portion 51) of the housing 5, the distal ends of the plurality of elastic contact pieces 42 (conductive parts) are held in position in a terminal housing part 6 of the housing 5 (specifically, in position in a direction orthogonal to the central axis C).

The connector terminal 2 configured as above is housed in the housing 5 with the distal end of the connection part 4 (i.e., the distal end of each of the elastic contact pieces 42) directed to a terminal insertion port 5A (see FIG. 2).

In the connector terminal 2 as aforementioned, the lance 412 is formed so that at least one end edge 412*a* (or 412*b*) out of the end edges 412*a* and 412*b* provided in the width direction on the side of the base part of the lance 412 comes close to the other end edge 412*b* (or 412*a*) as it advances toward the leading end of the lance 412. According to this configuration, when the tubular section 41 is deformed by, for example, pressing force to increase the curvature of the portion of the tubular section 41 near the base part of the lance 412 (i.e., the portion curved to bulge outward as seen from the opening direction of the tubular section 41), end edges 411B of the remaining portion of the tubular body 411, along which each lance 412 has been cut and raised (i.e., end edges respectively opposed to the end edges 412*a* and 412*b* of the lance 412 along the pair of cut lines 411A of the flat plate-shaped connector terminal 2) intrude into a gap (i.e., the space between the pair of end edges 411B: the position of the lance 412 before being cut and raised: see two short dashed lines in FIG. 8), as shown in, for example, FIG. 8. The end edges 411B intrude into the gap as aforementioned so that the base part of the lance 412 is pressed outward by the end edges 411B to thereby increase the opening degree of the lance 412. At this time, the distance between the end edges 412*a* and 412*b* of the base part of the lance 412 becomes small as it advances toward the leading end of the lance 412 (i.e., the proximal end side of the connector terminal 2), so that the end edges 411B that have intruded into the gap apply a greater force to the base part of the lance 412 to press the same outward than a force applied by the end edges 411B provided in parallel to each other. Consequently, the opening of the lance 412 (i.e., outward movement of the leading end of the lance 412) becomes more remarkable. The opening degree of the lance 412 is increased with increase in the amount of intrusion of the end edges 411B into the gap. Thus, the opening degree of the lance 412 can be increased (adjusted) by increasing (adjusting) the amount of intrusion of the end edges 411B into the gap.

When the amount of intrusion of the end edges 411B into the gap is too large, the base part of the lance 412 is deformed beyond its elastic deformation area to cause the lance 412 to fail to function as a lance. Thus, in the connector terminal 2 of this embodiment, the end edges 411B are caused to intrude into the gap within such a range that the deformation (i.e., the opening degree of the lance 412) falls within the elastic deformation area.

As shown in FIG. 1, FIG. 2, FIG. 7, and FIG. 9, the housing 5 includes the terminal housing part 6 that has the inner surface 50 (specifically, a second portion 52) surrounding the tubular section 41 of the connector terminal 2 in the circumferential direction and enables the connector terminal 2 to be housed therein. Specifically, the housing 5 includes the terminal housing part 6 and the terminal insertion port 5A through which the mating terminal pin P is inserted. The housing 5 also has the proximal end opening 5B through which the connector terminal 2 is inserted. A more specific description is provided below.

The housing 5 has a tubular shape having the central axis c, and is formed of an insulating resin. The housing 5 has the inner surface 50, and the inner surface 50 defines a space (a housing space) S in which the connector terminal 2 is housed. The terminal housing part 6 of this embodiment has the inner surface 50 and the housing space S. The terminal insertion port 5A is configured to communicate the housing space S with the external space in the direction of the central axis c at the distal end of the housing 5, and the proximal end opening 5B is configured to communicate the housing space S with the external space in the direction of the central axis c at the proximal end of the housing 5.

The inner surface 50 of this embodiment defines a circular or substantially circular cross section at every position in the direction of the central axis c (i.e., cross section in a surface direction orthogonal to the central axis c of the inner surface 50). The inner surface 50 defines a plurality of portions having different diameters. Specifically, the inner surface 50 has, in order from the distal end side to the proximal end side, the first portion 51 having a smallest diameter, the second portion 52 having a greater diameter than the first portion 51, and a third portion 53 having a greater diameter than the second portion 52 (having a greatest diameter).

The first portion 51 encloses the plurality of elastic contact pieces 42 through the inner surface 50, the second portion 52 encloses the tubular section 41 through the inner surface 50, and the third portion 53 encloses the terminal base 3 through the inner surface 50. The first portion 51 and the second portion 52 are connected to each other through a reduced diameter portion 54 that has a diameter reduced as it advances toward the distal end. The second portion 52 and the third portion 53 are connected to each other through a lance engagement part 55. The portions 51 to 55 that are defined by the inner surface 50 share the same central axis.

The lance engagement part 55 is arranged at a position corresponding to the lances 412 of the connection part 4 (specifically, the tubular section 41). The lance engagement part 55 is defined by partial reduction of the diameter of the inner surface 50, which is provided in the direction of the central axis c (a portion projecting toward the central axis c). Specifically, the lance engagement part 55 reduces its diameter to a diameter smaller than that of the second portion 52 as it advances from the end of the third portion 53 toward the distal end, and then increases its diameter as it advances further toward the distal end.

The proximal end portion of the third portion 53 defines the proximal end opening 5B that is formed in the proximal end portion of the housing 5. As aforementioned, the housing space S of the housing 5 and the external space communicate with each other through the proximal end opening 5B.

The housing 5 has a wall (distal end wall) 60 that defines the terminal insertion port 5A at the distal end of the housing 5. As aforementioned, the housing space S of the housing 5 and the external space communicate with each other also through the terminal insertion port 5A.

In the connector 1 configured as above, the pair of lances 412 opposed to each other in the circumferential direction of the tubular section 41 abut the inner surface 50 (specifically, the second portion 52) of the terminal housing part 6. Thus, the position of the tubular section 41 in the terminal housing part 6 (i.e., the position of the tubular section 41 in the housing 5 in the radial direction of the tubular section 41) is fixed.

In the connector 1 of this embodiment, the position of the connector terminal 2 within the housing 5 (i.e., the orientation of the central axis C of the connector terminal 2 relative to the central axis c of the housing 5) is regulated by the abutting of the distal ends of the plurality of elastic contact pieces 42 to the inner surface 50 (specifically, the first portion 52), that is, the abutting of a plurality of portions spaced apart from each other in the direction of the central axis C to the inner surface 50, in addition to the positioning of the tubular section 41 in the manner as aforementioned. Thus, the connector terminal 2 is fixed in the housing 5 to have the central axis C coinciding with the direction in which the mating terminal pin P is inserted and removed (i.e., the direction of the central axis c of the housing 5). That is, the central axis C of the connector terminal 2 is prevented from being inclined relative to the central axis c of the housing 5. As a result, the connector 1 of this embodiment effectively prevents the mating terminal pin P from being hardly connected thereto due to the connector terminal 2 directed obliquely in the housing 5.

Next, a size adjustment device capable of adjusting the opening degree of the lances 412 by pressing the tubular section 41 of the connector terminal 2 will be described with reference to FIG. 10 to FIG. 18.

Figure 13:
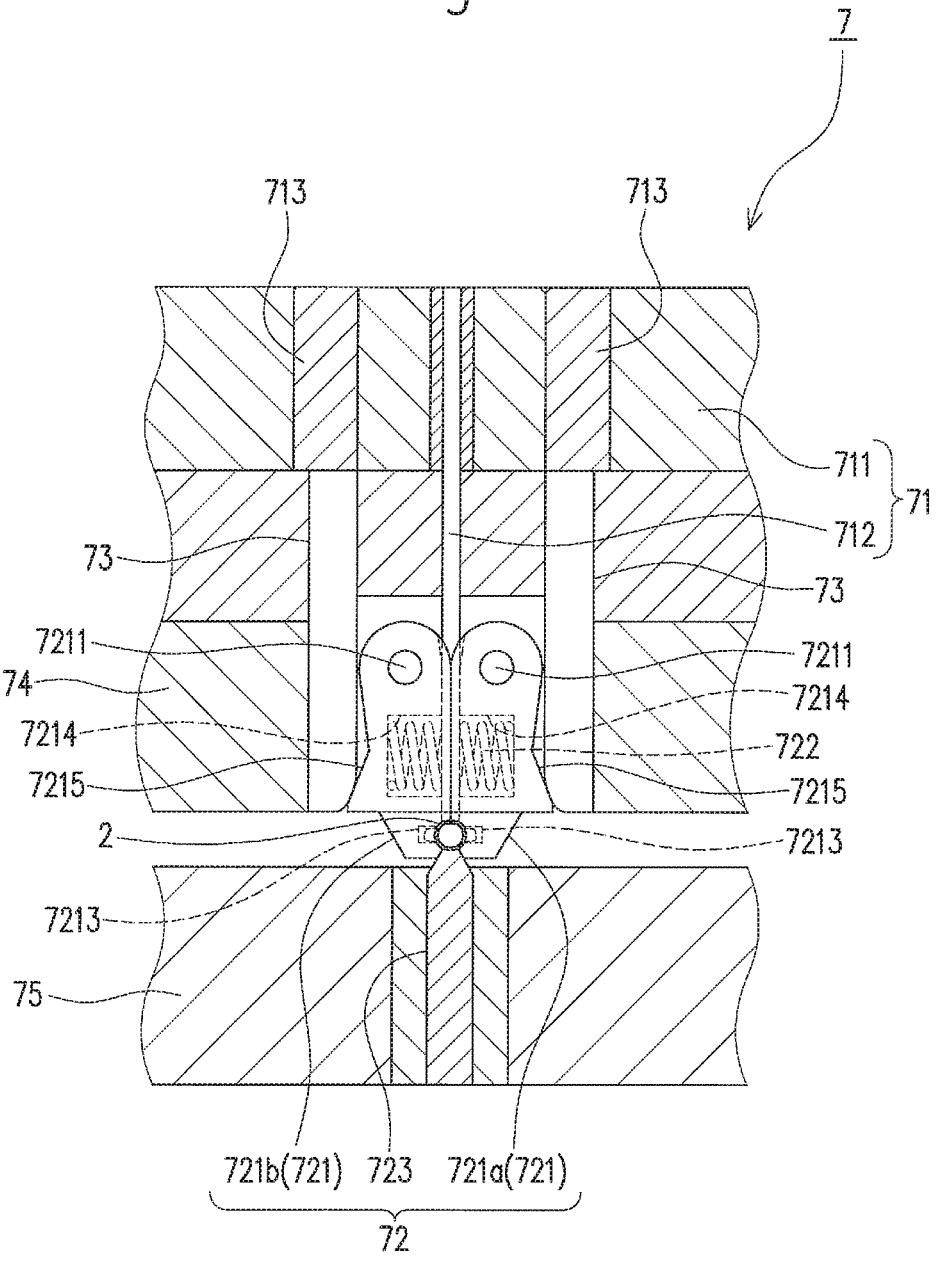
FIG. 13 is an explanatory view for the configuration and operation of the size adjustment device, showing a state where pinching of a tubular section of the connector terminal by the pair of pinching members and pressing of the tubular section by the second force transmission member are completed.
Figure 14:
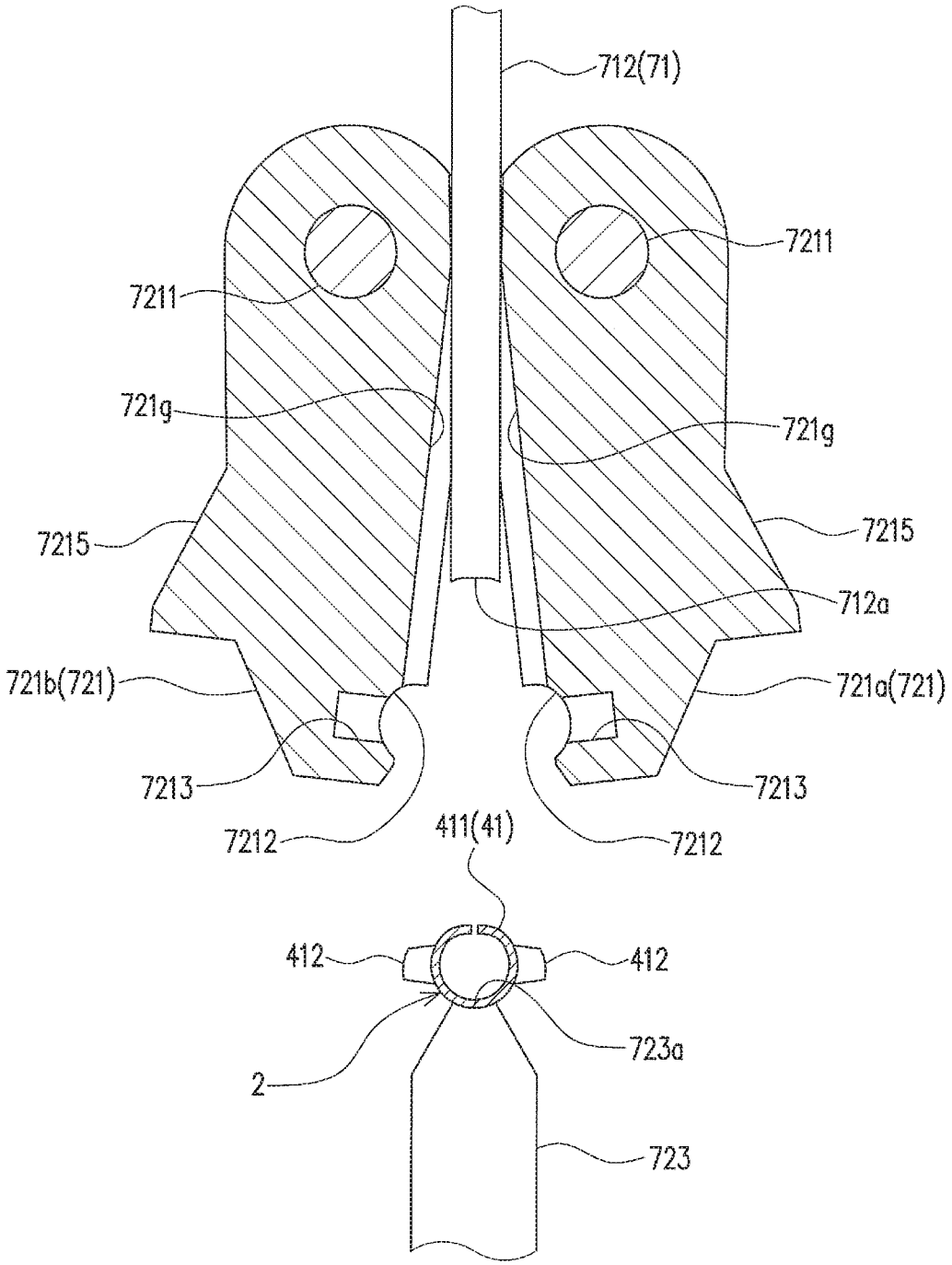
FIG. 14 is an explanatory view for the configuration of the size adjustment device at and around an arrangement position of the connector terminal, showing a state where the pair of pinching members are held at opening positions.
Figure 15:
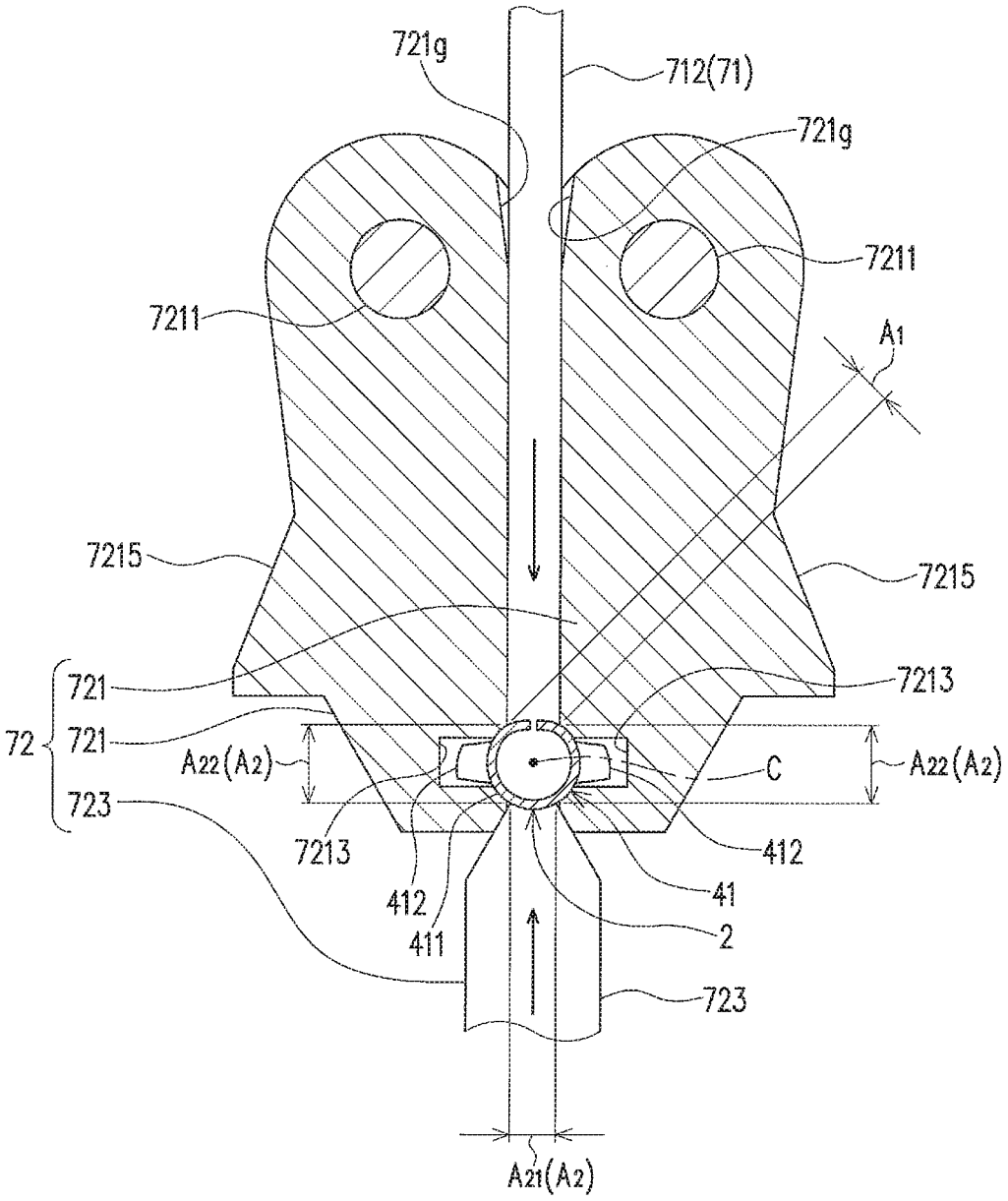
FIG. 15 is an explanatory view for the configuration of the size adjustment device at and around the arrangement position of the connector terminal, showing a state where the tubular section of the connector terminal is supported by a supporting unit and pressed by a pressing section.
Figure 16:
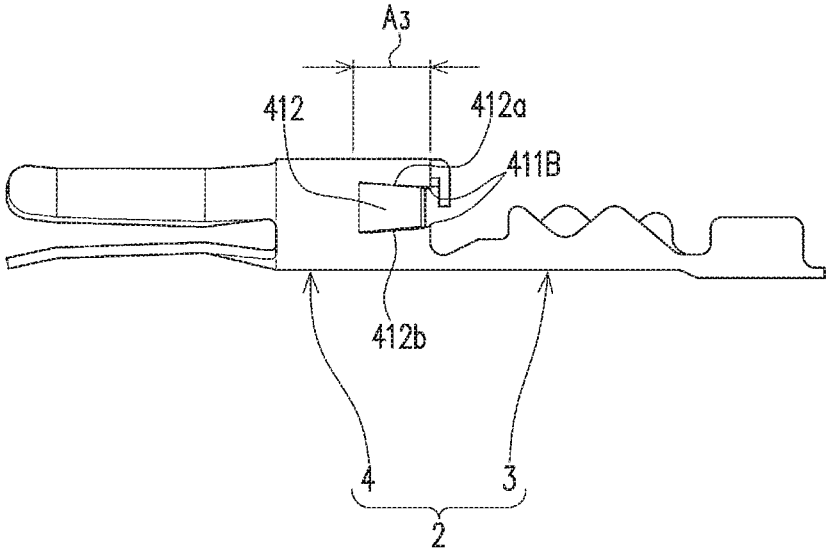
FIG. 16 is an explanatory view for a portion to be pressed of the connector terminal.

As shown in FIG. 10 to FIG. 15, a size adjustment device 7 includes: a pressing section 71 capable of pressing a portion to be pressed A1 (see FIG. 15), which is a portion in the circumferential direction of the tubular section 41, toward the inside of the tubular section 41 (i.e., toward the central axis C); and a supporting unit 72 capable of supporting a residual portion A2 in the circumferential direction of the tubular section 41 other than the portion to be pressed A1, by abutting on the residual portion A2 (including an opposed portion A21 and pinched portions A22: see FIG. 15) from the outer side. The size adjustment device 7 further includes a pair of first force transmission members 73 capable of reciprocating in the pressing direction of the pressing section 71 (the vertical direction in the example shown in FIG. 10).

Figure 10:
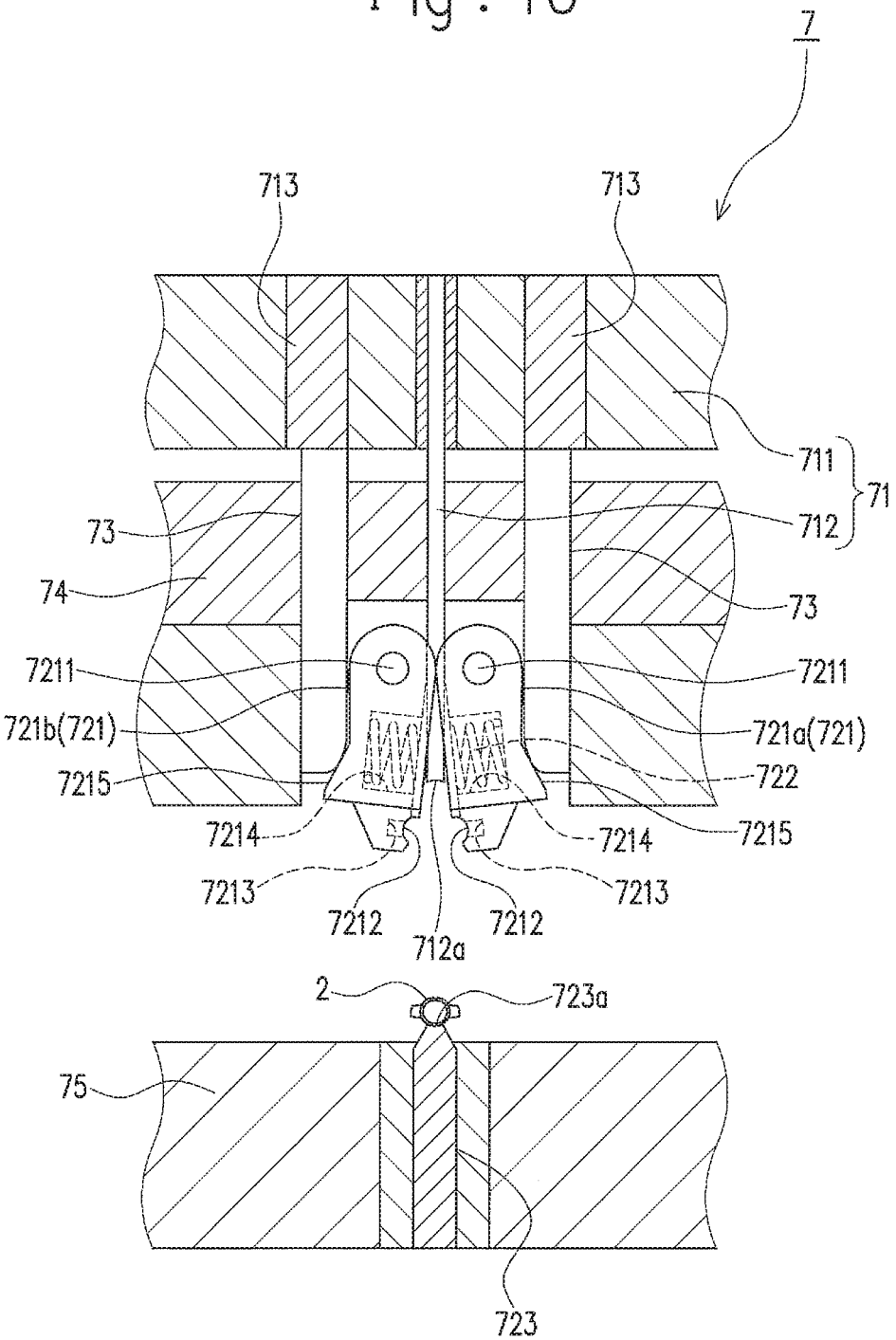
FIG. 10 is an explanatory view for the configuration and operation of a size adjustment device, showing a state where each component is in the initial position.

In the size adjustment device 7, the connector terminal 2 subjected to size adjustment (that is, the connector terminal 2 for which the opening degrees of the lances 412 are to be adjusted) is arranged (placed) so that the direction in which the pair of lances 412 are opposed to each other coincides with the horizontal direction (see FIG. 10). The portion to be pressed A1 of the tubular section 41 in this embodiment is a portion on one side in a direction orthogonal to the direction in which the pair of lances 412 are opposed to each other (i.e., the upper side in FIG. 15), as seen from the opening direction of the tubular section 41 (i.e., the direction of the central axis C of the connector terminal 2). In the tubular section 41 of this embodiment, the portion to be pressed A1 is a portion in which the edges in the longitudinal direction of a rectangular plate portion elongated in a direction orthogonal to the centerline C1 in the flat plate-shaped connector terminal 2 (see FIG. 6) are opposed to each other. As shown also in FIG. 16, the portion to be pressed A1 is a portion A3 including the boundary positions between the lances 412 and the tubular body 411, as seen from the direction in which the pair of lances 412 are opposed to each other. The size adjustment device 7 of this embodiment is configured to press the portion to be pressed A1 to reduce its dimension toward the central axis C of the connector terminal 2 by about 0.5 to 2.0 times the plate thickness.

The pressing section 71 includes a pressing part 711 capable of pressing in the vertical direction (specifically, downward in the vertical direction), and a second force transmission member 712 extending in the vertical direction and configured to transmit pressing force applied by the pressing part 711 to the portion to be pressed A1.

The second force transmission member 712 has one end (the upper end) connected to the pressing part 711, and the other end (the lower end) having a pressing surface 712*a* that is configured to press the portion to be pressed A1 of the connector terminal 2 arranged at a specific position (i.e., arrangement position). The pressing surface 712*a* has a shape corresponding to that of the portion to be pressed A1. Specifically, the pressing surface 712*a* has a curved surface bulging upward as seen from the direction of the central axis C of the connector terminal 2, and has a rectangular shape elongated in the direction of the central axis C of the connector terminal 2 as seen from the vertical direction.

The supporting unit 72 includes a pair of pinching members 721 capable of pinching the tubular section 41 from a direction substantially orthogonal to the vertical direction (i.e., the left and right direction in FIG. 10). The supporting unit 72 also includes a spring member 722 between the pair of pinching members 721. The supporting unit 72 further includes an opposed portion supporting member 723 capable of supporting the opposed portion A21 of the tubular section 41 that is opposed to the portion to be pressed A1. The pair of pinching members 721 of this embodiment are mounted to an elevating member 74 arranged between the pressing part 711 and the opposed portion supporting member 723 and configured to reciprocate in the vertical direction in association with the pressing part 711. The opposed portion supporting member 723 of this embodiment is arranged (integrated) in a conveyance base 75 on which the connector terminal 2 is conveyed.

Each of the pair of pinching members 721 includes a rotation fulcrum 7211 at a position closer in the vertical direction to the pressing part 711 (i.e., on the upper side in FIG. 10) than the arrangement position of the tubular section 41. Each pinching member 721 pivotally moves with the rotation fulcrum 7211 as a rotation center (that is, pivotally moves about the rotation fulcrum 7211), so that the pair of pinching members 721 pinch the tubular section 41 (see FIG. 11 to FIG. 13). The second force transmission member 712 is arranged so as to pass through between the pair of pinching members 721. The pair of pinching members 721 of this embodiment respectively have vertically extending grooves 721*g* in portions (surfaces) opposing to each other (see FIG. 14 and FIG. 15). The second force transmission member 712 vertically moves (reciprocates) along the grooves 721*g* to press the portion to be pressed A1 of the tubular section 41.

Specifically, each of the pair of pinching members 721 has on its leading end side a pinching surface 7212 located at an inner end portion in the pinching direction, that is, the pinching surface 7212 of one pinching member 721*a* is located at an end portion close to the other pinching member 721*b* and the pinching surface 7212 of the other pinching member 721*b* is located at an end portion close to the one pinching member 721*a* (see FIG. 14). Each of the pair of pinching members 721 has an inclined surface 7215 located at an outer end portion in the pinching direction, that is, the inclined surface 7215 is located at an end portion on the opposite side to the other pinching member 721*b* and the inclined surface 7215 of the other pinching member 722*b* is located at an end portion on the opposite side to the one pinching member 721*a* (see FIG. 14).

The pinching surfaces 7212 are configured to abut the residual portion A2 of the tubular section 41 that is pinched by the pinching surfaces 7212, specifically, a pinched portion A22 that is the residual portion A2 other than the opposed portion A21 (see FIG. 14 and FIG. 15). Each of the pinching surfaces 7212 is curved to have an arc shape as seen from the direction of the central axis C of the connector terminal 2 arranged at the arrangement position, and has a curvature corresponding to that of the tubular section 41. The pinching surface 7212 has a recess 7213 at a position corresponding to the lance 412.

Each of the recesses 7213 is provided to prevent the corresponding lance 412 from contacting the pinching member 721 when the pinching surface 7212 abuts the tubular section 41, that is, when the pair of pinching members 721 pinch the tubular section 41 (see FIG. 13 and FIG. 15).

Each of the inclined surfaces 7215 is inclined relative to the moving direction of the first force transmission members 73, that is, the pressing direction of the pressing section 71 (the vertical direction in this embodiment), and is inclined to be away from the counterpart pinching member 721 (i.e., a pinching member 721*b* (or 721*a*) that is different from the pinching member 721*a* (or 721*b*) having such an inclined surface 7215) as it advances away from the pressing part 711. The inclined surface 7215 is located below the corresponding first force transmission member 73.

The spring member 722 is arranged between the pair of pinching members 721 and between the rotation fulcrums 7211 and the pinching surfaces 7212 in the vertical direction. Specifically, the spring member 722 is arranged between spring member mounting recesses 7214 respectively provided in the surfaces of the pinching members 721 facing each other. The spring member 722 uses its resilient force (i.e., a spring return force) to press the pair of pinching members 721 in a direction in which the distance between the pinching surfaces 7212 increases. The spring member 722 of this embodiment is, for example, a compression coil spring.

The opposed portion supporting member 723 has a support surface 723*a* that supports from below the tubular section 41 (i.e., the opposed portion A21) of the connector terminal 2 arranged at the arrangement position of the size adjustment device 7 (see FIG. 10 and FIG. 14). The support surface 723*a* is curved to have an arc shape as seen from the direction of the central axis C of the connector terminal 2 arranged at the arrangement position, and has a curvature corresponding to that of the tubular section 41 (i.e., the opposed portion A21). The support surface 723*a* projects toward the pressing section 71 from the conveyance base 75 (i.e., toward the upper side in FIG. 10).

Each of the pair of the first force transmission members 73 is arranged between the pressing part 711 and the inclined surface 7215 of the corresponding one of the pinching members 721*a* and 721*b* in the vertical direction. The first force transmission members 73 of this embodiment are vertically elongated members, each having one end (the upper end in FIG. 10) connected to the pressing part 711 via a cam 713. The first force transmission members 73 are guided by the elevating member 74 to enable reciprocating motion in the vertical direction. The first force transmission members 73 are guided by the elevating member 74 to move downward when pressed by the pressing part 711. This movement causes leading ends of the first force transmission members 73 (i.e., ends opposite to the pressing part 711 side) to press the inclined surfaces 7215 downward. Since the pinching member 721*a* (or 721*b*) is capable of pivotally moving about its rotation fulcrum 7211, the pinching member 721*a* (or 721*b*) pivotally moves to such a direction that its leading end moves closer to the leading end of the counterpart pinching member 721*b* (or 721*a*) when the first force transmission members 73 slide along the inclined surfaces 7215 while pressing the inclined surfaces 7215 downward (see FIG. 11 to FIG. 13). The pair of pinching members 721 thereby pivotally move respectively to directions in which the pinching surfaces 7212 pinch the tubular section 41 against the resilient force of the spring member 722.

The size adjustment device 7 of this embodiment is incorporated into a pressing device for forming the connector terminal 2 by stamping out a metal sheet into a specific shape (the flat plate-shaped connector terminal 2) and then bending the respective portions of the stamped metal sheet (the flat plate-shaped connector terminal 2).

The size adjustment device 7 configured as above adjusts the opening degree of the lances 412 relative to the tubular body 411 by adjusting the size of the tubular section 41 of the connector terminal 2 in a manner described below.

The connector terminal 2 is conveyed on the conveyance base 75 to the position of the opposed portion supporting member 723. The connector terminal 2 at this time is arranged so that the pair of lances 412 are aligned in the horizontal direction, that is, a direction in which the pair of lances 412 are opposed to each other coincides with the horizontal direction. In the size adjustment device 7 of this embodiment, the connector terminal 2 is arranged so that the joint of the tubular section 41 formed by curving the rectangular flat plate portion (i.e., the portion in which the short sides of the curved rectangular flat plate portion are opposed to each other) is directed upward.

Next, when the connector terminal 2 is arranged (placed) on the support surface 723*a* of the opposed portion supporting member 723 (see FIG. 10), the pressing part 711 and the elevating member 74 start moving downward. At this time, the leading ends of the pair of pinching members 721 are held away from each other due to the resilient force of the spring member 722 (see FIG. 10 and FIG. 11).

Figure 11:
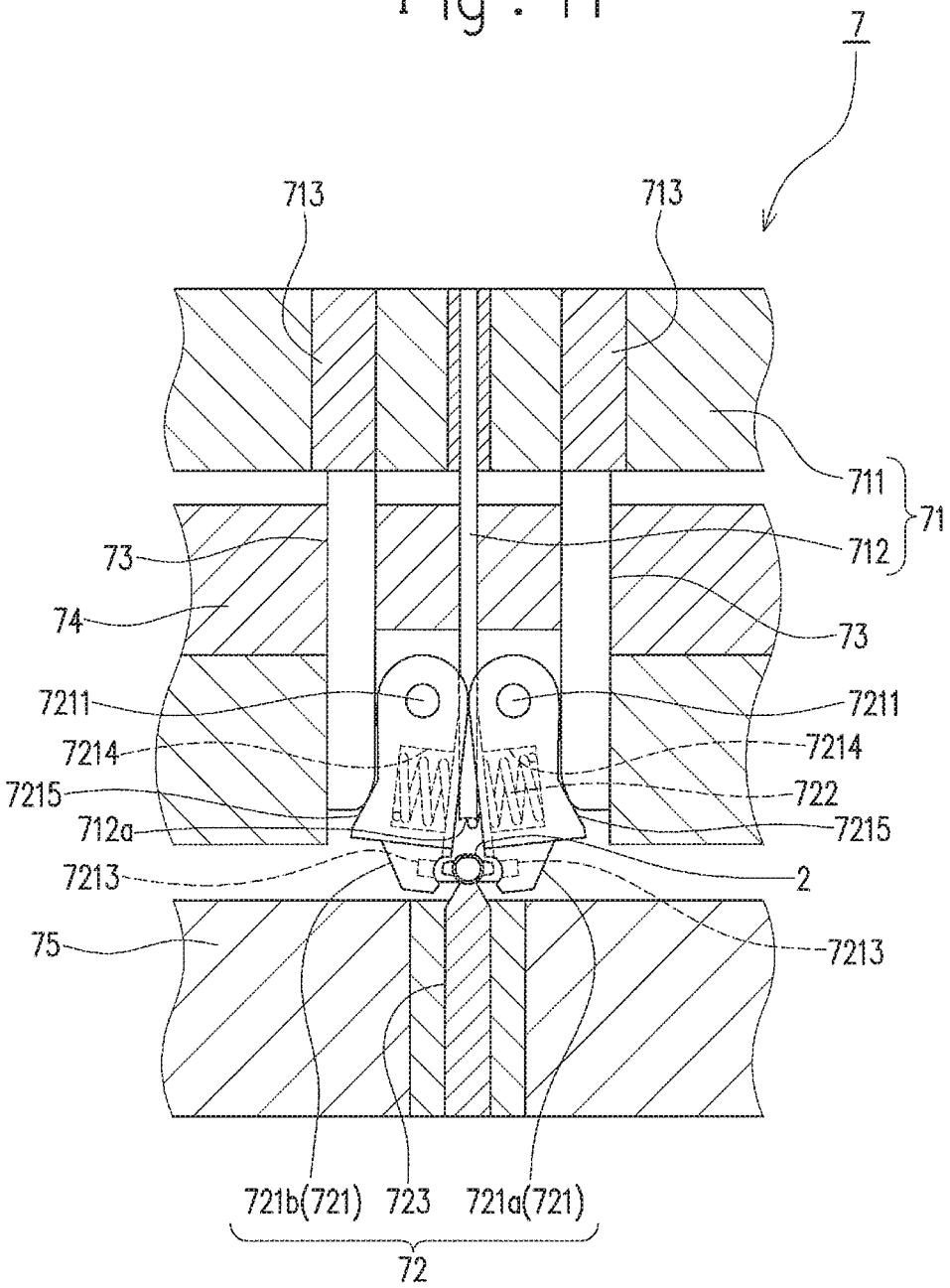
FIG. 11 is an explanatory view for the configuration and operation of the size adjustment device, showing a state where a pair of pinching members move downward to a pinching position.
Figure 12:
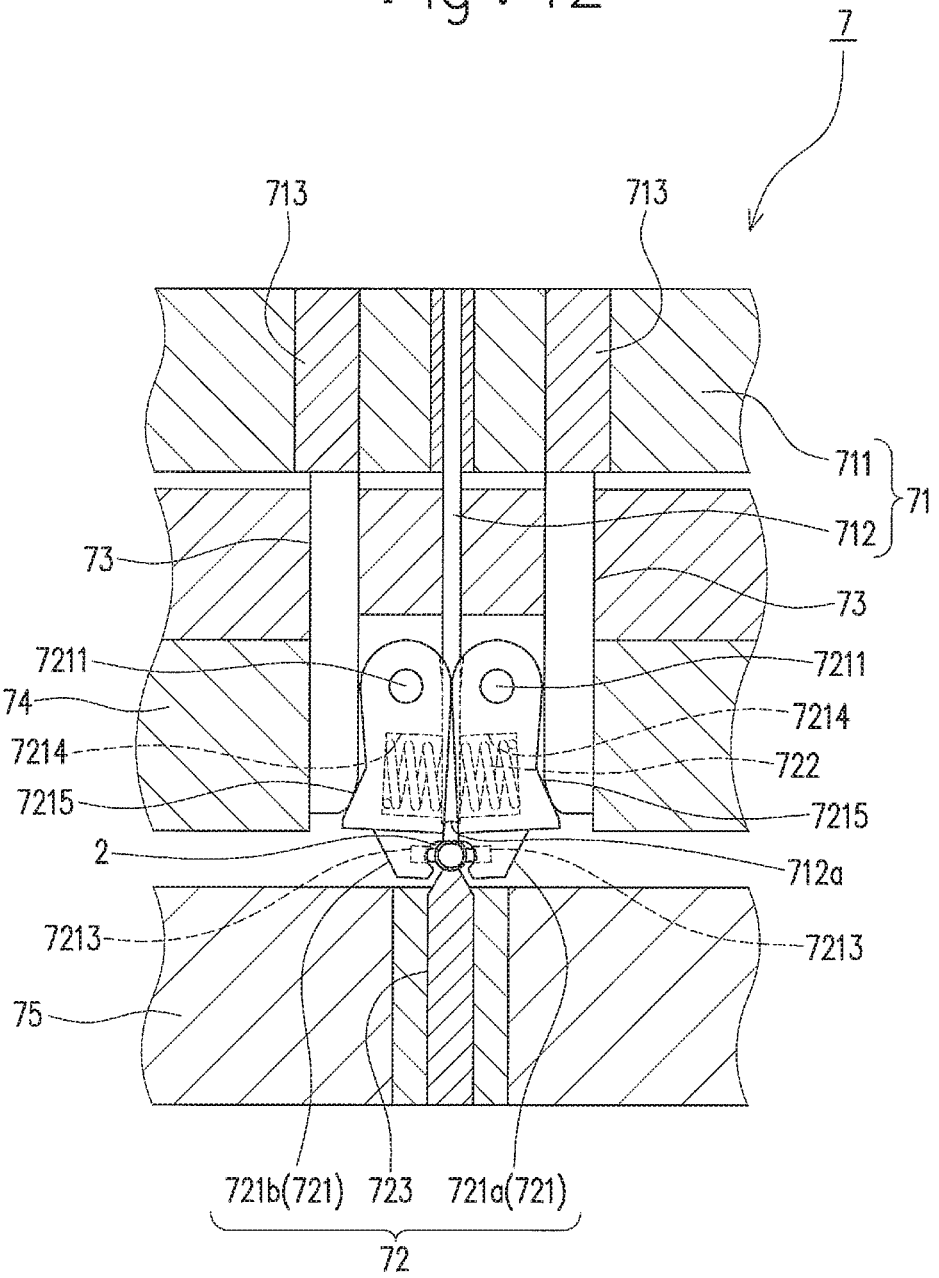
FIG. 12 is an explanatory view for the configuration and operation of the size adjustment device, showing a state where the pair of pinching members pivotally move and a second force transmission member moves downward.

When the elevating member 74 moves downward to a specific height position (i.e., such a height position that the pair of pinching members 721 can pivotally move and thereby pinch the tubular section 41), the elevating member 74 stops moving downward while the pressing part 711 continues moving downward (see FIG. 11 and FIG. 12). The continued downward movement only of the pressing part 711 with the elevating member 74 stopped enables the pair of the first force transmission members 73 and the second force transmission member 712 to move downward with respect to the pinching members 721.

The first force transmission members 73 move downward with respect to the pair of pinching members 721 to press downward the respective inclined surfaces 7215 of the pinching members 721. The first force transmission members 73 continue moving downward in this state to slide along the respective inclined surfaces 7215, so that the pair of pinching members 721 pivotally move to pinch the tubular section 41, specifically, the pinched portion A22 of the tubular section 41 (see FIG. 12 and FIG. 13).

At the time of pinching the tubular section 41 by the pair of pinching members 721, the downward movement of the pressing part 711 causes the second force transmission member 712 to move downward to a specific position (i.e., a preset position according to the intended opening degrees of the lances 412), and the downward movement of the second transmission member 712 causes pressing the tubular section 41, specifically, the portion to be pressed A1 of the tubular section 41 (see FIG. 13).

In the size adjustment device 7, the pinching of the tubular section 41 by the pair of pinching members 721 and the pressing of the tubular section 41 by the second force transmission member 712 (tubular section 41) are completed simultaneously. That is, in the size adjustment device 7 of this embodiment, the leading ends (i.e., the pinching surfaces 7212) of the pair of pinching members 721 finish closing and the second force transmission member 712 reaches its bottom dead point at the same time.

Thus, the portion to be pressed A1 of the tubular section 41 is pressed while the residual portion A2 of the tubular section 41 is supported (held) from the outer side by the supporting unit 72 (i.e., the pair of the pinching members 721 and the opposed portion supporting member 723). This pressing causes deformation of the tubular section 41 (specifically, deformation of the tubular section 41 to increase the curvature of the tubular section 41 at the base parts and their proximities of the lances 412) and to thereby change the size (the diameter in this embodiment) thereof, so that the opening degree of the lances 412 is adjusted.

Next, the pressing part 711 moves upward so that the first force transmission members 73 move upward relative to the respective inclined surfaces 7215, and the resilient force of the spring member 722 thereby acts on the pair of pinching members 721 to open their leading ends (the pinching surfaces 7212). The pressing part 711 moves upward so that the second force transmission member 712 also moves upward, and consequently the components of the size adjustment device 7, such as the components 71, 721, and 73, return to their original positions (see FIG. 10). The opening degree of the lances 412 of the connector terminal 2 is thus adjusted.

According to the size adjustment device 7 as aforementioned, the portion to be pressed A1 is pressed by the pressing section 71 while the residual portion A2 of the tubular section 41 is supported (held) from the outer side by the supporting unit 72. Thus, the size adjustment device 7 of this embodiment can decrease (adjust) the size of the tubular section 41 (in this embodiment, the diameter in a direction orthogonal to the direction in which the pair or lances 412 are opposed to each other, i.e., in the vertical direction) while preventing or reducing deformation of the residual portion A2 of the tubular section 41.

Figure 17:
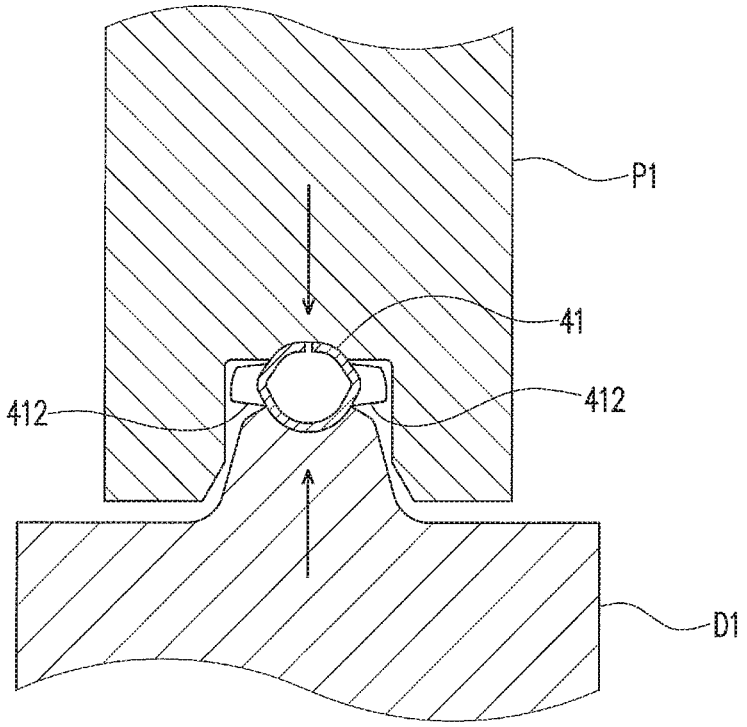
FIG. 17 is an explanatory view for a state where the connector terminal is deformed by a pressing force.

As described above, the connector terminal 2 including the tubular section 41 provided with the lances 412, as in this embodiment, is arranged at the arrangement position, and the pressing section 71 presses and deforms the tubular section 41 in a direction in which the portion of the tubular section 41 at the base parts and their proximities of the lances 412 have a large curvature. Thereby, the opening degree of the lances 412 can be adjusted, while a significant deformation of the tubular section 41 (i.e., deformation to bend a part of the peripheral wall) caused by vertically pressing the tubular section 41 using, for example, a die D1 and a punch P1 as shown in FIG. 17 is prevented or reduced.

As in the size adjustment device 7 of this embodiment, the inclined surface 7215 with which the corresponding first force transmission member 73 moved by the pressing of the pressing part 711 is in sliding contact is provided to each of the pair of pinching members 721 capable of pivotally moving about the respective rotation fulcrums 7211, so that the pair of pinching members 721 can support (pinch) the residual portion A2 using the power to press the portion to be pressed A1 of the tubular section 41 (i.e., pressing force in the pressing direction by the pressing part 711). That is, the size adjustment device 7 of this embodiment enables both the pressing downward of the portion to be pressed A1 and the supporting of the residual portion A2 by pinching the same from the pinching direction (i.e., a direction substantially orthogonal to the pressing direction), only by the pressing in a single direction (i.e., downward) by the pressing section 711.

Figure 18:
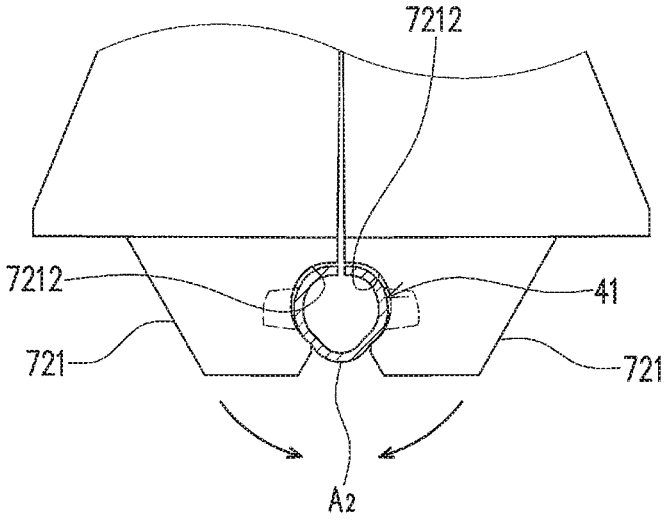
FIG. 18 is an explanatory view for the case where the tubular section of the connector terminal is pinched by portions of the pair of pinching members other than their pinching surfaces.

In the size adjustment device 7 of this embodiment, the opposed portion supporting member 723 supports the opposed portion A21 of the tubular section 41 that is arranged at the arrangement position, in a direction opposite to the direction in which the tubular section 41 is pressed by the pressing section 71 (i.e., downward in this embodiment). This securely prevents downward displacement of the tubular section 41 from the arrangement position due to the pressing by the pressing section 71 or the second force transmission member 712). Thus, any deformation resulting from the aforementioned displacement of the tubular section 41 (for example, as shown in FIG. 18, any deformation resulting from the aforementioned displacement which is in turn caused by the tubular section 41 partially pinched by portions of the pair of pinching members 721 that are different from the portions of the pair of pinching member 721 to be served for pinching the residual portion A2 (i.e., the portions of the pair of pinching members 721 by which the residual portion A2 is pinched and hence supported: the pinching surfaces 7212 in this embodiment)) can be prevented.

In the size adjustment device 7 of this embodiment, the pressing of the tubular section 41 by the pressing section 71 and the pinching of the tubular section 41 by the pair of pinching members 721 are completed simultaneously.

In the case where the tubular section 41 is pressed or supported (restrained) by a plurality of members at a plurality of positions in the circumferential direction, as is done by the size adjustment device 7 of this embodiment, it may occur that the tubular section 41 is displaced from the arrangement position depending on the timing at which the pressing or supporting members 71, 721, and 723 press the tubular section 41, and that the displaced portion of the tubular body 41 is pinched and thereby deformed between the pressing or supporting members (for example, between the pinching member(s) 721 and the opposed portion supporting member 723, or between the second force transmission member 712 (i.e., the pressing section 71) and the pinching member(s) 721). However, as is done by the size adjustment device 7 of this embodiment, the tubular section 41 is pressed or supported by the members (such as the second force transmission member 712 (the pressing section 71), the pinching members 721, and the opposed portion supporting member 723) at the plurality of positions to complete the pressing or supporting by the members 712, 721, and 723 simultaneously, so that the deformation resulting from the aforementioned displacement (i.e., the deformation caused by the pinching between the pressing members) can be suitably prevented.

It is a matter of course that the connector terminal, connector, and size adjustment device of the present invention are not limited to the aforementioned embodiment, but various modifications can be made without departing from the gist of the present invention. For example, a configuration of an embodiment may be added to a configuration of another embodiment, and part of a configuration of an embodiment may be replaced by a configuration of another embodiment. Further, part of a configuration of an embodiment may be deleted.

The aforementioned embodiment has been described by taking, for example, the case where each of the pair of lances 412 that is formed by cutting a part of the peripheral wall of the tubular section 41 of the connector terminal 2 and raising the same about its base part has a tapered shape (i.e., the shape in which the distance between the pair of end edges 412*a* and 412*b* becomes small as it advances from the base part of the lance 412 to the leading end thereof), without limitation thereto.

Figure 19:
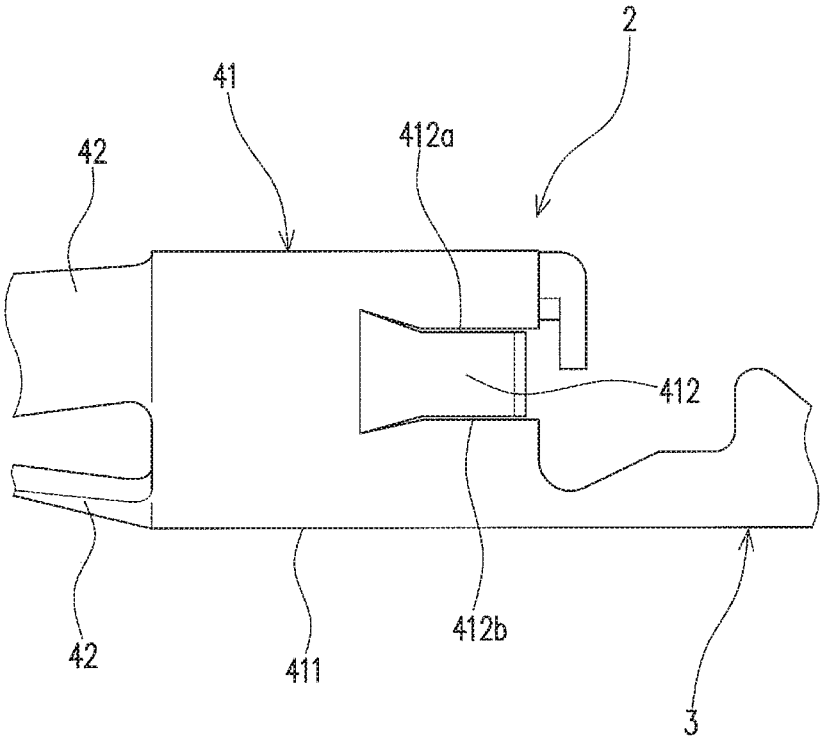
FIG. 19 is an explanatory view for a lance of a connector terminal according to another embodiment.
Figure 20:
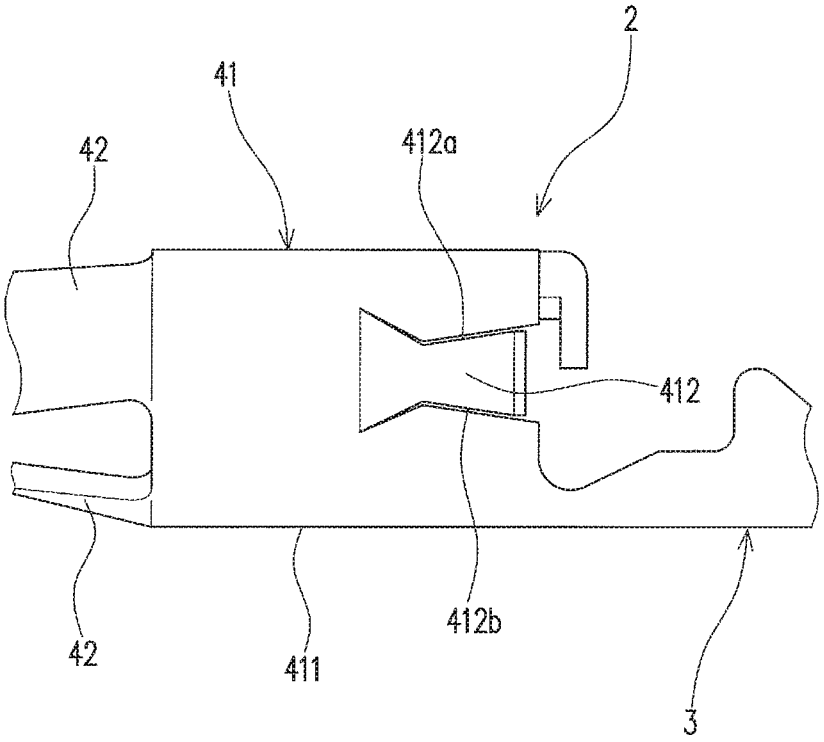
FIG. 20 is an explanatory view for a lance of a connector terminal according to another embodiment.

For example, as shown in FIG. 19 and FIG. 20, the lance 412 can have such a tapered shape that the pair of end edges 412*a* and 412*b* only in the base part of the lance 412 become close to each other as it advances from the base end of the lance 412 (i.e., the boundary between the lance 412 and the tubular body 411) toward the leading end thereof.

Figure 21:
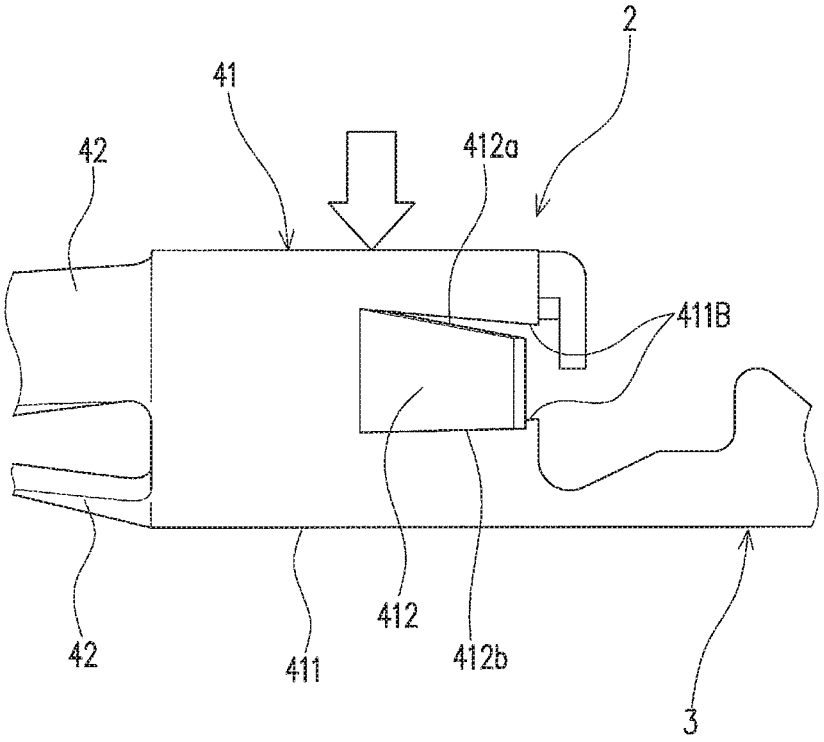
FIG. 21 is an explanatory view for a lance of a connector terminal according to another embodiment.

As shown in FIG. 21, the lance 412 can also have such a tapered shape that only one of the pair of end edges 412*a* and 412*b* (the end edge 412*a* in FIG. 21) comes close to the other end edge (the end edge 412*b* in FIG. 21) as it advances toward the leading edge of the lance 412. In this case, it is preferable that the tubular section 41 be pressed from the side of the end edge 412*a* coming close to the other end edge 412*b* (i.e., the upper side in FIG. 21: see the arrow in FIG. 21) when the opening degree of the lance 412 is adjusted. This is because the end edges 411B of the remaining tubular body 411 other than the lance 412 that has been cut and raised intrude into the gap of the tubular body 411 (i.e., the position of the lance 412 before being cut and raised) by a greater amount than in the case where the tubular section 41 is pressed from the other side, and consequently the opening degree of the lance 412 is larger than that of the lance 412 when the pressing is made from the other side.

The aforementioned embodiment has been described by taking, for example, the case where the end edges 412*a* and 412*b* of the lance 412 extend straight (i.e., have a linear shape), without limitation thereto. The end edges 412*a* and 412*b* of the lance 412 can be, for example, curved. That is, the shape of the end edges 412*a* and 412*b* in the base part of the lance 412 is not limited to a specific shape as long as at least one end edge 412*a* (or 412*b*) comes close to the other end edge 412*b* (or 412*a*) as it advances toward the leading end of the lance 412.

Figure 22:
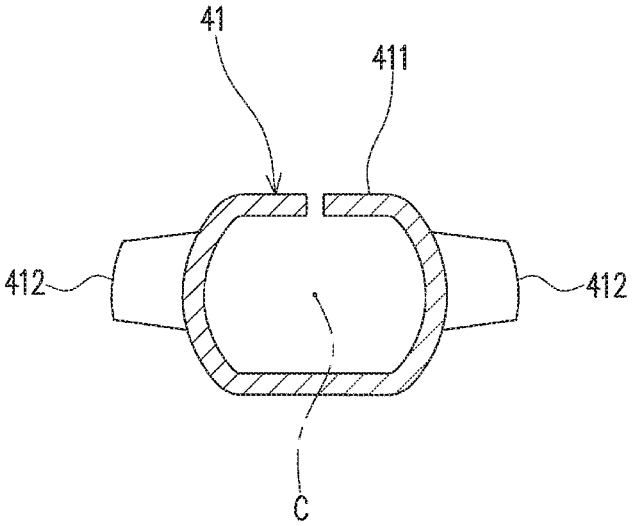
FIG. 22 is an explanatory cross sectional view for the shape of a tubular section of a connector terminal according to another embodiment.

The aforementioned embodiment has been described by taking, for example, the case where the tubular section 41 has a circular cylindrical shape, without limitation thereto. For example, as shown in FIG. 22, as long as a portion of the tubular section 41 including the boundary between the tubular body 411 and the lance 412 is curved as seen from the direction of the central axis C, the other portion of the tubular section 41 can have, for example, a flat shape. That is, the shape of the other portions of the tubular section 41 is not limited to a specific shape.

Figure 23:
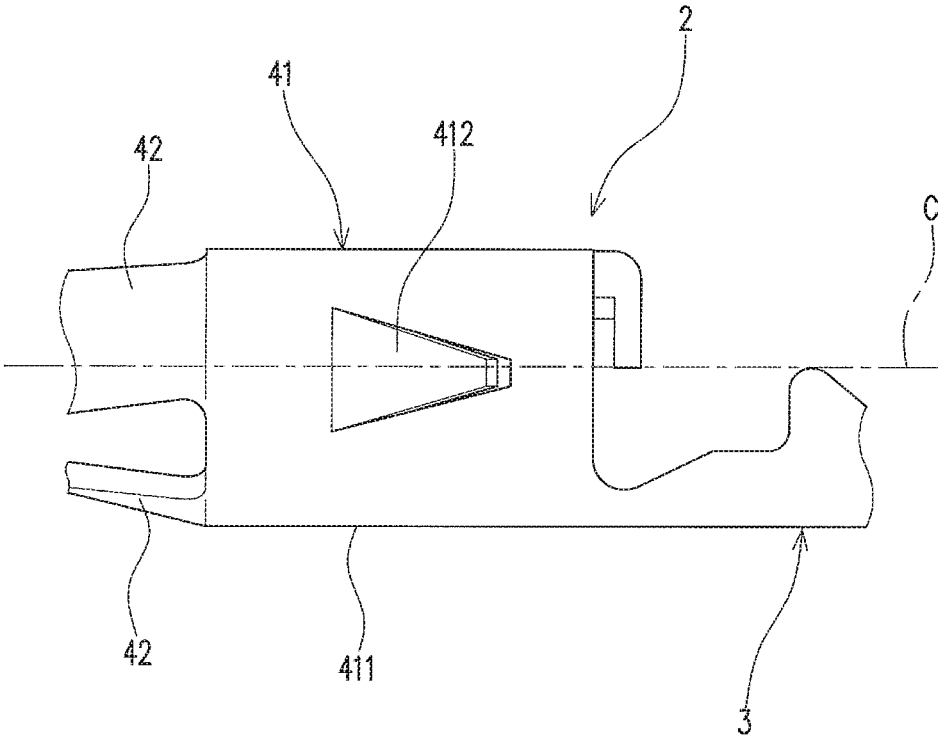
FIG. 23 is an explanatory view for the position of a lance at a tubular section of a connector terminal of another embodiment.

The aforementioned embodiment has been described by taking, for example, the case where the lance 412 is cut and raised from the tubular section 41 so as to include the proximal end edge of the tubular body 411, without limitation thereto. For example, as shown in FIG. 23, the configuration can be such that the lance 412 is formed by cutting a central portion in the direction of the central axis C of the tubular body 411 and raising the same about its base part, that is, such that the lance 412 is formed by cutting a portion that does not include the proximal end edge of the tubular body 411 and raising the same about its base part.

The aforementioned embodiment has been described by taking, for example, the case where the tubular section 41 has a pair of lances 412, without limitation thereto. The tubular section 41 can have one lance 412, or three or more lances 412.

The aforementioned embodiment has been described by taking, for example, the case where the connector terminal 2 is of a so-called female type, without limitation thereto. The connector terminal 2 can be of a so-called male type. That is, the connector terminal 2 can be either of a male type or a female type as long as the connector terminal 2 includes the tubular section 41 provided with the lance(s) 412.

The aforementioned embodiment has been described by taking, for example, the case where the size adjustment device 7 is configured to adjust the size of the tubular section 41 of the connector terminal 2, without limitation thereto. The size adjustment device 7 can be configured to adjust the size of a tubular conductive part of a connector terminal into and from which the mating terminal pin P is inserted and removed. An object to be adjusted by the size adjustment device 7 is not limited to a part of a connector terminal. The object can be a plastically-deformable tubular section of a member, such as a tubular section formed of metal or the like (for example, a crimping sleeve, and a split sleeve of an optical connector). Although used to adjust the size of such a member, the size adjustment device 7 is configured to press a portion to be pressed in the state where the residual portion of the tubular section is supported from the outer side, so that the size adjustment device 7 can decrease (adjust) the size of the tubular section while preventing or suppressing the deformation of the residual portion of the tubular section.

The aforementioned embodiment has been described by taking, for example, the case where, in the size adjustment device 7, a single drive source (i.e., the pressing part 711) is used for the pressing of the tubular section 41 by the second force transmission member 712 and for the pinching of the tubular section 41 by the pair of pinching members 721, without limitation thereto. For example, a drive source used for the second force transmission member 712 to press the tubular section 41 can be different from a drive source used for the pair of pinching members 721 to pinch the tubular section 41. In this case, each of the pair of pinching members 721 does not need to have the inclined surface 7215.

Figure 24:
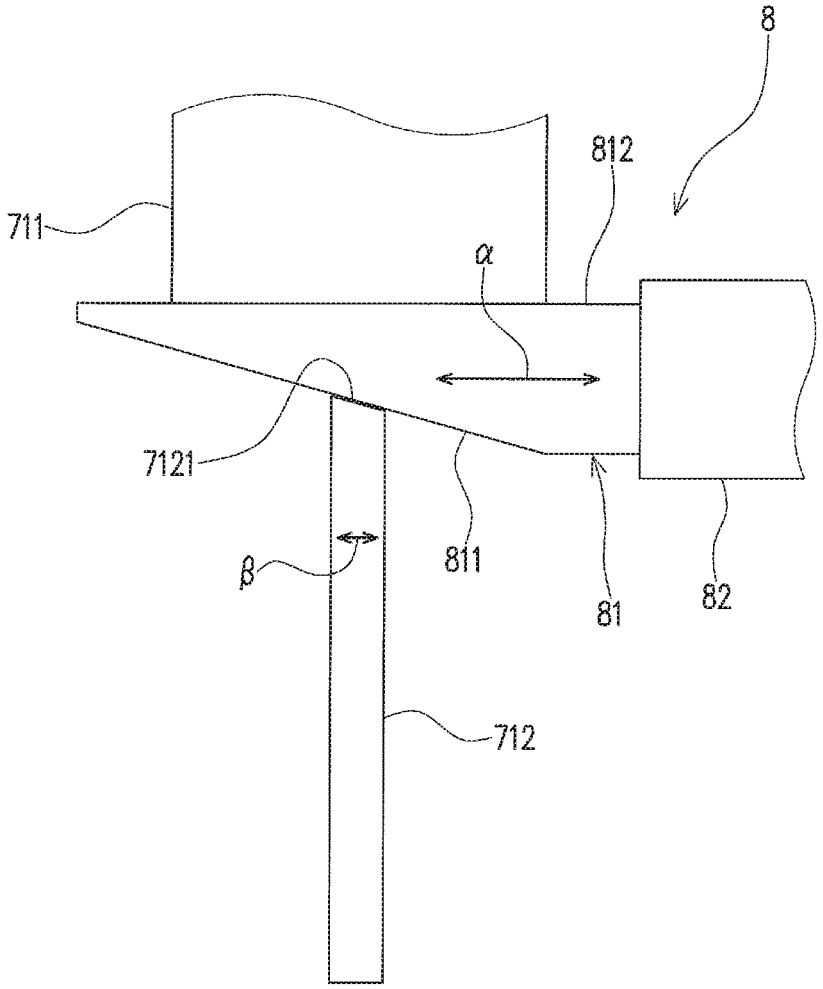
FIG. 24 is a schematic explanatory view for a position changing mechanism for changing the position of the bottom dead point of a second force transmission member.
Figure 25:
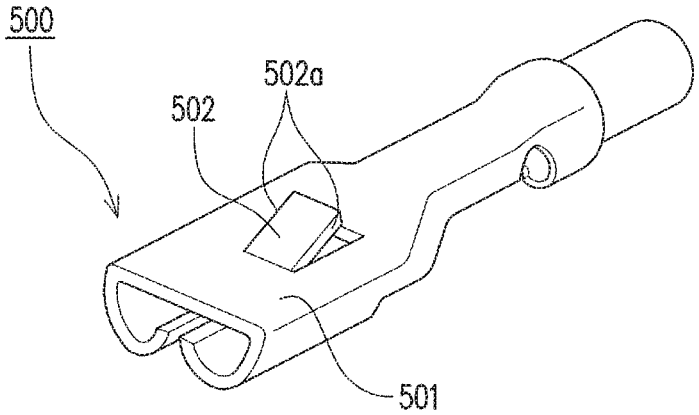
Fig. 25 (Prior Art)
FIG. 25 is a perspective view of a connector terminal including a conventional lance, to which an electric wire is connected.

The aforementioned embodiment has been described by taking, for example, the case where, in the size adjustment device 7, the second force transmission member 712 is replaced with another second force transmission member 712 having a different dimension in the vertical direction (i.e., the pressing direction) to change the opening degree of the lance 412 (that is, the dimension in the vertical direction of the tubular section 41 that has been pressed), without limitation thereto. The size adjustment device 7 can include a position changing mechanism 8, as shown in FIG. 24, configured to change the position of the bottom dead point of the second force transmission member 712 (i.e., the position at which the second force transmission member 712 reaches the lowest point). The specific configuration of the position changing mechanism 8 is as described below.

The position changing mechanism 8 includes an intervening member 81 that intervenes between the pressing part 711 and the second force transmission member 712 in the pressing direction of the pressing part 711 (i.e., the vertical direction in FIG. 24), and a drive part 82 configured to move the intervening member 81 in the advancing and retracting direction substantially orthogonal to the pressing direction (i.e., the left and right direction in FIG. 24: see the arrow $\alpha$).

The intervening member 81 moves in the advancing and retracting direction so that the distance in the pressing direction between the pressing part 711 and the second force transmission member 712 can be changed. Specifically, the intervening member 81 has an inclined surface 811 inclined relative to the pressing direction. The inclined surface 811 is inclined to be away from an opposite surface 812 that extends straight along the advancing and retracting direction, as it advances from a leading end of the intervening member 81 in the advancing and retracting direction toward a base end thereof (i.e., toward the drive part 82). The inclined surface 811 is opposed to a corresponding inclined surface (i.e., an end face on the pressing part 711 side) 7121 of the second force transmission member 712.

According to such a configuration, the drive unit 82 moves the intervening member 81 in the advancing and retracting direction so as to change the distance in the pressing direction between the pressing part 711 and the second force transmission member 712, and thus the position of the bottom dead point in the pressing direction of the second force transmission member 712 is changed without replacement of the second force transmission member 712.

The size adjustment device 7 is configured to enable the second force transmission member 712 to move in the advancing and retracting direction (see the arrow $\beta$) while a direction in which the second force transmission member 712 reciprocates (at the time of pressing the tubular section 41) is made to coincide with the pressing direction (i.e., the vertical direction in FIG. 24), so that the position at which the second force transmission member 712 presses the tubular section 41 (i.e., the position to be pressed by the second transmission member 712) can be changed in the advancing and retracting direction. In this case, the drive part 82 causes the intervening member 81 to move in the advancing and retracting direction in conjunction with the movement of the second force transmission member 712 in the advancing and retracting direction, so that the position at which the tubular section 41 is pressed in the advancing and retracting direction can be changed without changing the position in the pressing direction of the bottom dead point of the second force transmission member 712.

The aforementioned embodiment has been described by taking, for example, the case where the size adjustment device 7 is incorporated into a pressing device for forming the connector terminal 2 by bending the flat plate-shaped connector terminal, without limitation thereto. The size adjustment device 7 can be a stand-alone device.

The aforementioned embodiment has been described by taking, for example, the case where the size adjustment device 7 is configured to adjust the size of the tubular section 41 that has a circular cylindrical shape, without limitation thereto. The size adjustment device 7 can be configured to adjust the size of the tubular section in, for example, a prism shape.

The connector terminal, connector, and size adjustment device of the present embodiment are as described above. However, the present invention is not limited thereto, and the design can be appropriately modified within the scope intended by the present invention. The operational advantage of the present invention is also not limited to the foregoing embodiments.

The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope to the scope of the claims

The invention claimed is:

1. A connector terminal comprising:

a tubular section having a tubular body surrounding a central axis and a lance formed by cutting a part of the tubular body and angling the cut part about its base part away from the tubular body, wherein the tubular section comprises a portion including a boundary between the tubular body and the lance, wherein the portion is curved to bulge outward as seen from a direction of the central axis, and wherein the lance has a pair of end edges opposed to each other in a width direction orthogonal to the central axis, and at least one of the pair of end edges at least on the side of the base part of the lance is formed to taper toward an opposite one of the pair of end edges as the at least one tapered end edge advances toward a leading end of the lance;

wherein the lance has a trapezoid portion and a rectangle portion extending from the trapezoid portion.

2. A connector, comprising:

the connector terminal according to claim 1; and a connector housing having an inner surface that surrounds the tubular section of the connector terminal in a peripheral direction and having a terminal housing part configured to house the connector terminal, wherein the tubular section has the pair of lances provided at positions opposed to each other in the peripheral direction, and wherein each of the pair of the lances has a leading end abutting the inner surface.

3. The connector according to claim 2, wherein the connector terminal has a conductive part that is arranged on one side in the opening direction of the tubular section and enables a mating terminal to be detachably connected to itself from the opening direction, and the connector terminal is housed in the terminal housing part with the conductive part held in position.

* * * * *